US007471173B2

(12) United States Patent
Hidaka et al.

(10) Patent No.: US 7,471,173 B2
(45) Date of Patent: Dec. 30, 2008

(54) RESONATOR, FILTER, NONRECIPROCAL CIRCUIT DEVICE, AND COMMUNICATION APPARATUS

(75) Inventors: Seiji Hidaka, Nagaokakyo (JP); Hiromu Tokudera, Nagaokakyo (JP); Kei Matsutani, Osaka-fu (JP)

(73) Assignee: Murata Manufacturing Co., Ltd (JP)

( * ) Notice: Subject to any disclaimer, the term of this patent is extended or adjusted under 35 U.S.C. 154(b) by 288 days.

(21) Appl. No.: 10/578,496

(22) PCT Filed: Aug. 26, 2004

(86) PCT No.: PCT/JP2004/012260

§ 371 (c)(1),
(2), (4) Date: May 5, 2006

(87) PCT Pub. No.: WO2005/045986

PCT Pub. Date: May 19, 2005

(65) Prior Publication Data

US 2007/0080761 A1 Apr. 12, 2007

(30) Foreign Application Priority Data

Nov. 6, 2003 (JP) ..... 2003-377433

(51) Int. Cl.
*H01P 1/20* (2006.01)
*H01P 1/32* (2006.01)

(52) U.S. Cl. ..... 333/204; 333/1.1; 333/202

(58) Field of Classification Search ..... 333/1.1, 333/24.2, 204, 202, 205; 343/700 MS, 770
See application file for complete search history.

(56) References Cited

U.S. PATENT DOCUMENTS

| | | | | |
|---|---|---|---|---|
| 5,805,034 | A | 9/1998 | Evans et al. | |
| 6,472,960 | B1 | 10/2002 | Ishikawa et al. | |
| 6,762,655 | B2 | 7/2004 | Wichern | |
| 2003/0201941 | A1 * | 10/2003 | Aikawa et al. | 343/700 MS |

FOREIGN PATENT DOCUMENTS

| | | |
|---|---|---|
| JP | 08-059210 | 10/1996 |
| JP | 2001-85935 | 3/2001 |
| JP | 2001-203513 | 7/2001 |
| JP | 2002-9515 | 1/2002 |
| JP | 2003-142919 | 5/2003 |

OTHER PUBLICATIONS

International Search Report PCT/JP2004/012260, Sep. 9, 2004.

* cited by examiner

*Primary Examiner*—Stephen E Jones
(74) *Attorney, Agent, or Firm*—Dickstein, Shapiro, LLP.

(57) ABSTRACT

A dielectric substrate is provided with first and second conductor openings communicating with each other via a first slit, and third and fourth conductor openings communicating with each other via a second slit, and the slits intersect each other. With this structure, two resonant modes including an even mode in which magnetic field vectors are directed from the first to third conductor openings and from the fourth to second conductor openings, and an odd mode in which magnetic field vectors are directed from the third to second conductor openings and from the first to fourth conductor openings, or two resonant modes including an X mode in which magnetic field vectors are directed from the first to second conductor openings, and a Y mode in which magnetic field vectors are directed from the third to fourth conductor openings are generated.

12 Claims, 27 Drawing Sheets

(A)

(B)

(A)

(B)

(A)

(B)

(C)

(A)

(B)

RESONATOR, FILTER, NONRECIPROCAL CIRCUIT DEVICE, AND COMMUNICATION APPARATUS

FIELD OF THE INVENTION

The present invention relates to a resonator, a filter, a nonreciprocal circuit device, and a communication apparatus for use in, for example, wireless communication in the microwave band or millimeter-wave band or transmission and reception of electromagnetic waves.

BACKGROUND OF THE INVENTION

Non-Patent Document 1 and Patent Documents 1 and 2 disclose magnetic-resonance isolators. Such magnetic-resonance isolators of the related art utilize a phenomenon in which when high-frequency currents of equal amplitude whose phases differ by $\pi/2$ radians flow in two perpendicular lines, a rotating magnetic field (circularly polarized wave) is produced at the intersection thereof and the rotational direction of the circularly polarized wave reverses depending on the traveling direction of the electromagnetic wave along the two lines. Specifically, a ferrimagnetic member is disposed at the intersection, and a static magnetic field needed for magnetic resonance is applied. When the traveling direction of the electromagnetic wave propagating in the principal line is the reverse direction, the circularly polarized wave produced at the intersection is a positive circularly polarized wave, and resonance absorption occurs. When the direction of the electromagnetic wave propagating in the principal line is the forward direction, the circularly polarized wave is a negative circularly polarized wave, and resonance absorption does not occur so that the electromagnetic wave can be transmitted.

FIG. 28 illustrates the structure disclosed in Non-Patent Document 1. In the example shown in FIG. 28, lines composed of conductor layers 6*a*, 6*b*, and 6*c* are held from the upper and lower sides thereof between dielectric substrates 1*a* and 1*b* each having a shield electrode 7 to form a balanced strip line, and a cross-shaped $\lambda/4$ resonator is defined in the conductor layer 6*a*. A circularly polarized wave is produced at the intersection of the resonator and the principal line extending in the horizontal direction, and the rotational direction of the circularly polarized wave changes in the forward or reverse direction depending on the traveling direction of the electromagnetic wave propagating in the principal line. By applying a static magnetic field needed for magnetic resonance to a ferrite core 16, for example, in the case of a positive circularly polarized wave, resonance absorption occurs, and, in the case of a negative circularly polarized wave, absorption does not occur and the electromagnetic wave is transmitted. This arrangement acts as an isolator.

FIG. 29 illustrates the structure of the isolator disclosed in Patent Document 1. In the example shown in FIG. 29, a ferrite core 16 is disposed in the central portion of a dielectric plate 1, and a bonded conductor 17 having four ports perpendicular to each other is disposed on the top of the ferrite core 16. One of two opposed ports of the four ports is provided with a lumped-constant capacitor 19, and the other port is provided with a lumped-constant inductor 20. The remaining opposed ports serve as input/output terminals 18.

FIG. 30 illustrates the structure of the nonreciprocal circuit device disclosed in Patent Document 2. In the example shown in FIG. 30, a disk-shaped ferrite core 16 is embedded in the central portion of a corner-shaped dielectric plate 1. On the upper surface of the electric plate 1, matching circuits 18*a* and 18*b* are disposed in four port of a bonded conductor 17, with the ends thereof being used as input/output terminals. The two remaining ports are provided with lines 18*c* and 18*d* that are connected with open-end lines configured such that lines 18*c*' and 18*d*' are defined on dielectric plates 1' and 1'.

Patent Document 1: Japanese Unexamined Patent Application Publication No. 63-260201

Patent Document 2: Japanese Unexamined Patent Application Publication No. 2001-326504

Non-Patent Document 1: Tadashi Hashimoto, "Maikuroha Feraito to sono Oyo Gijutsu (Microwave Ferrite and its Applied Technology)", the first edition, Sogo Denshi Shuppansha, May 10, 1997, pp. 83-84

Neither of Patent Document 1 or 2 or Non-Patent Document 1 discloses a substantially cross-shaped strip-line resonance isolator that is formed by intersecting microstrip lines. The facts that the fundamental mode is a dual mode and that the magnetic field vectors are orthogonal to each other in the vicinity of the intersection, i.e., that a circularly polarized wave is produced at a certain frequency, are utilized to form a magnetic-resonance isolator. However, such a nonreciprocal circuit device of the related art is designed to operate at a half wavelength or a quarter wavelength because of the use of microstrip lines. It is difficult to reduce the size because the pattern size is determined based on the dielectric constant of the substrate. Further, the magnetic field distribution is of the distributed-constant type, and a region in which a circularly polarized wave having the magnetic resonance absorption effect is produced is also of the distributed-constant type. Thus, the absorption efficiency with respect to the volume of a magnetic-material member is low, and it is also difficult to reduce the size of the magnetic-material member.

In a microstrip-line resonator composed of a nonreciprocal circuit device of the related art, the magnetic field vectors are expanded to the outside in which no microstrip-line electrodes exist. This limits the compactness and integration of the circuit.

SUMMARY OF THE INVENTION

It is an object of the present invention to provide a resonator, a filter, and a nonreciprocal circuit device that can be compact and integrated without increasing the complexity of the overall structure, and a communication apparatus including the same.

A resonator of the present invention includes a substrate, and a conductor layer defined on the substrate, wherein the conductor layer is provided with first and second conductor openings communicating with each other via a first slit, and third and fourth conductor openings communicating with each other via a second slit, and the first slit and the second slit intersect each other.

The resonator of the present invention further includes a capacitance-forming conductor layer that is brought into proximity to the conductor layer with an insulating layer therebetween in a thickness direction of the insulating layer, wherein the capacitance-forming conductor layer is placed at a position facing four sections of the conductor layer that is sectioned by the intersecting first and second slits.

In the resonator of the present invention, a magnetic field or an electric field of two resonant modes in which a magnetic field vector enters or exits the first through fourth conductor openings is unbalanced to resolve the degeneracy of the two resonant modes.

In the resonator of the present invention, at least one of the first through fourth conductor openings includes a resonant element including the following structure.

The resonant element includes one or a plurality of ring-shaped resonance units, each resonance unit being defined by one or a plurality of conductor lines and having a capacitive area and an inductive area, wherein an end of the conductor line is brought into adjacency with the other end of the conductor line or an end of another conductor line included in the same resonance unit in a width direction or a thickness direction to form the capacitive area.

A filter of the present invention includes the resonator, and signal input/output means coupled to the resonator.

A nonreciprocal circuit device of the present invention includes the resonator, and a magnet that applies a direct-current magnetic field to a ferrite member, the ferrite member being defined in a region surrounded by the first through fourth conductor openings.

In the nonreciprocal circuit device of the present invention, the first slit and the second slit intersect at substantially a right angle.

A communication apparatus of the present invention includes at least one of the resonator, the filter, and the nonreciprocal circuit device.

According to the resonator of the present invention, the conductor layer on the substrate is provided with the first and second conductor openings communicating with each other via the first slit, and the third and fourth conductor openings communicating with each other via the second slit, and the first slit and the second slit intersect each other. Therefore, the intersecting first and second slits act as capacitive areas due to the gaps, and the first through fourth conductor openings act as inductive areas. The capacitive areas and the inductive areas are used to operate as a slot resonator. The magnetic field vector in this resonant mode enters and exits four slots, and is not expanded outwards in the plan-view direction from the conductor openings, resulting in less leakage of energy to the outside of the resonator. This is effective in enhancing the compactness and integration of the circuit.

Further, according to the present invention, the capacitance-forming conductor layer is opposed to the conductor layer with the insulating layer therebetween, and the capacitance-forming conductor layer is placed at a position facing four sections of the conductor layer sectioned by the intersecting first and second slits. With the structure of the conductor layer, the dielectric layer, and the conductor layer, a capacitance is generated in the thickness direction, and a large capacitance in proportion to the dimension of the capacitance-forming conductor layer is obtained. This allows a reduction in the size of the resonator.

Further, according to the present invention, the magnetic field or electric field of two resonant modes in which the magnetic field vector enters or exits the first through fourth conductor openings is unbalanced to resolve the degeneracy of the two resonant modes, resulting in a coupled two-stage resonator. It is possible to provide a filter band design including the resonator and input/output means.

Further, according to the present invention, at least one of the first through fourth conductor openings includes a step-ring resonant element. The presence of the step-ring resonant element allows a reduction in current concentration due to the edge effect that occurs at the edges of the conductor opening, and the loss reduction effect is achieved.

Further, according to the present invention, the filter includes the resonator having any of the above-described structures and signal input/output means coupled to the resonator, thus achieving a compact, integrated design.

Further, according to the present invention, a ferrite member is placed in a region surrounded by the first though fourth conductor openings of the resonator having any of the above-described structures, and a magnet that applies a direct-current magnetic field to the ferrite member is provided. Thus, a nonreciprocal circuit device, such as an isolator, is provided.

Further, according to the present invention, the first slit and the second slit intersect at substantially a right angle. This leads to a magnetic field distribution without deviation through the four conductor openings, and a high Q-factor is achieved equivalently in the even mode and the odd mode.

Further, according to the present invention, a compact, lightweight, low-cost communication apparatus including at least one of the resonator, filter, and nonreciprocal circuit device, which are compact and integrated without increasing the complexity of the overall structure, is obtained.

Figure 1:
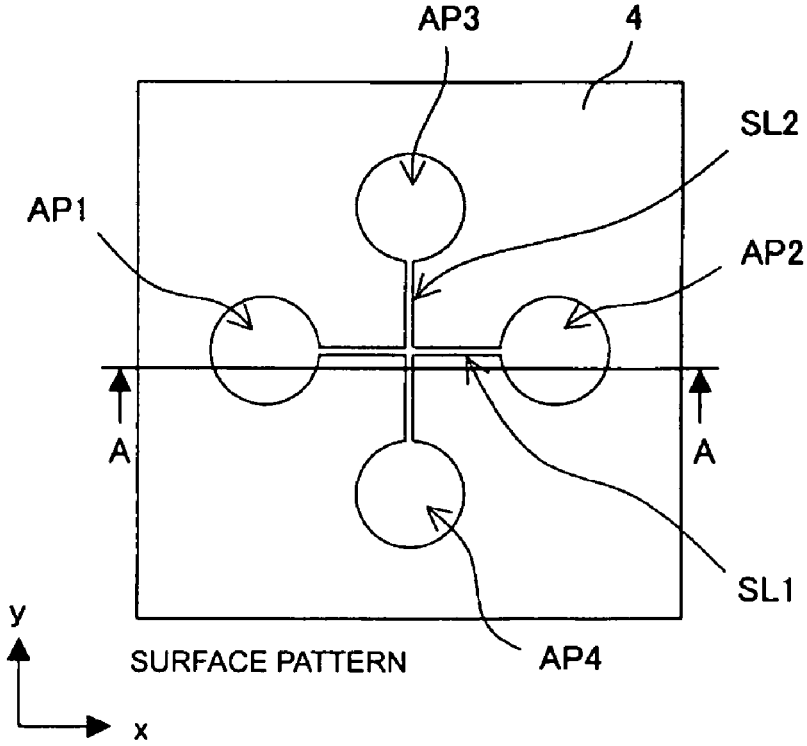
FIGS. 1(A) and 1(B) are diagrams showing a structure of a resonator according to a first embodiment.
Figure 1:
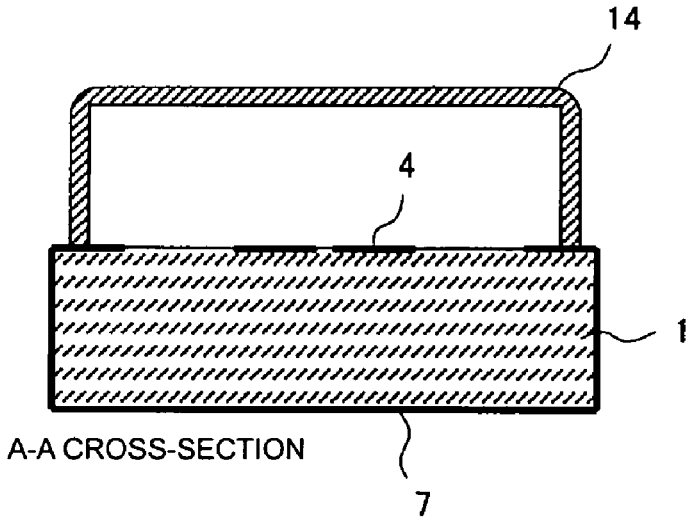

| Reference Numerals | |
|---|---|
| 1 | dielectric substrate |
| 2 | conductor line |
| 2' | conductor line aggregate |
| 3 | insulating layer |
| 4 | conductor layer |
| 5 | capacitance-forming conductor layer |
| 6 | conductor layer |
| 7 | shield electrode |
| 8 | input/output terminal |
| 9 | input/output-coupling electrode |
| 10 | via-hole |
| 11 | capacitance-coupling electrode |
| 13 | shield case |
| 14 | shield cap |
| 15 | substrate |
| 16 | ferrite core |
| 17 | magnet |
| 100 | resonant element |
| 120 | communication apparatus |
| AP | conductor opening |
| SL | slit |
| SLL | slot |

DETAILED DESCRIPTION OF THE INVENTION

Figure 2:
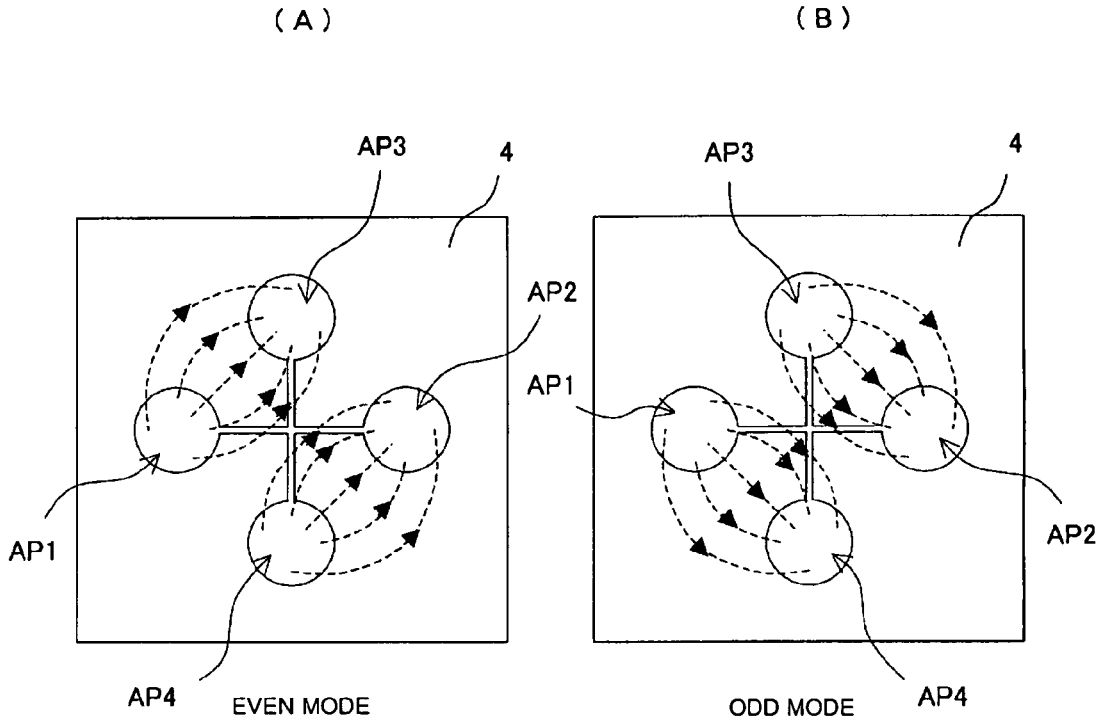
FIGS. 2(A) and 2(B) are diagrams showing two resonant modes of the resonator.
Figure 3:
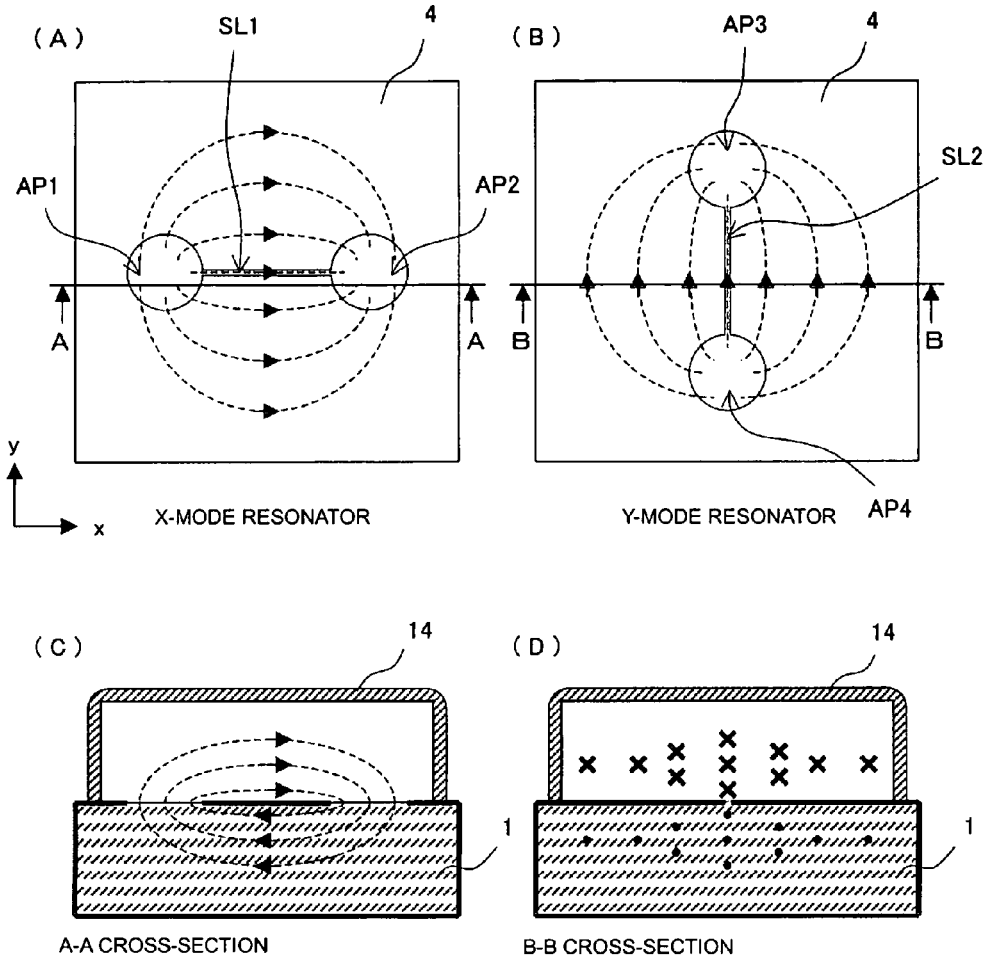
FIGS. 3(A)-3(D) are diagrams showing other two resonant modes in the resonator.
Figure 4:
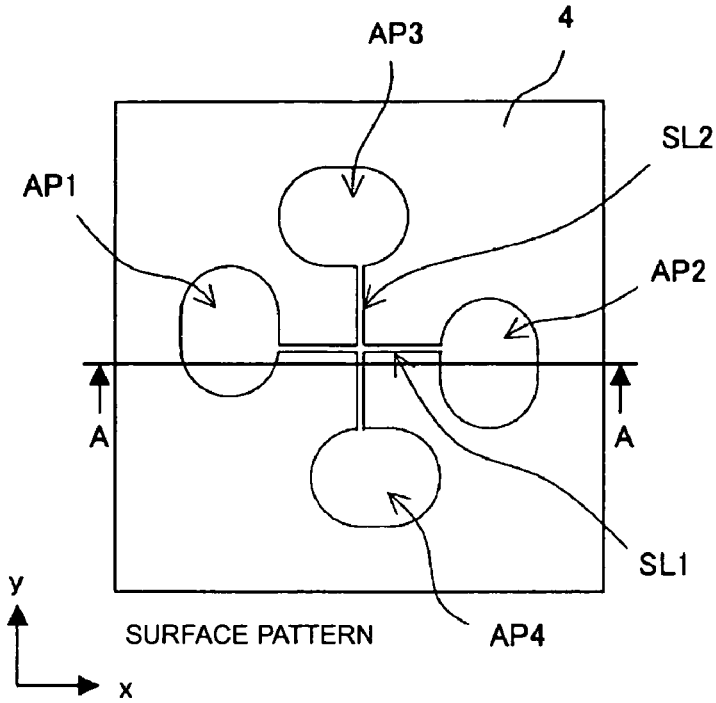
FIGS. 4(A) and 4(B) are diagrams showing a structure of a resonator according to a second embodiment.
Figure 4:
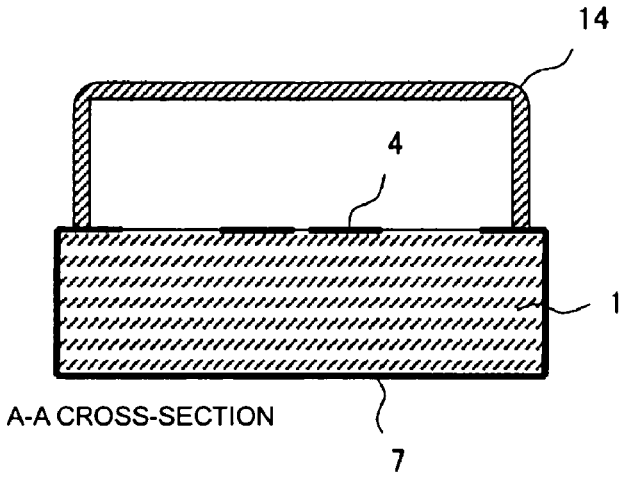
Figure 5:
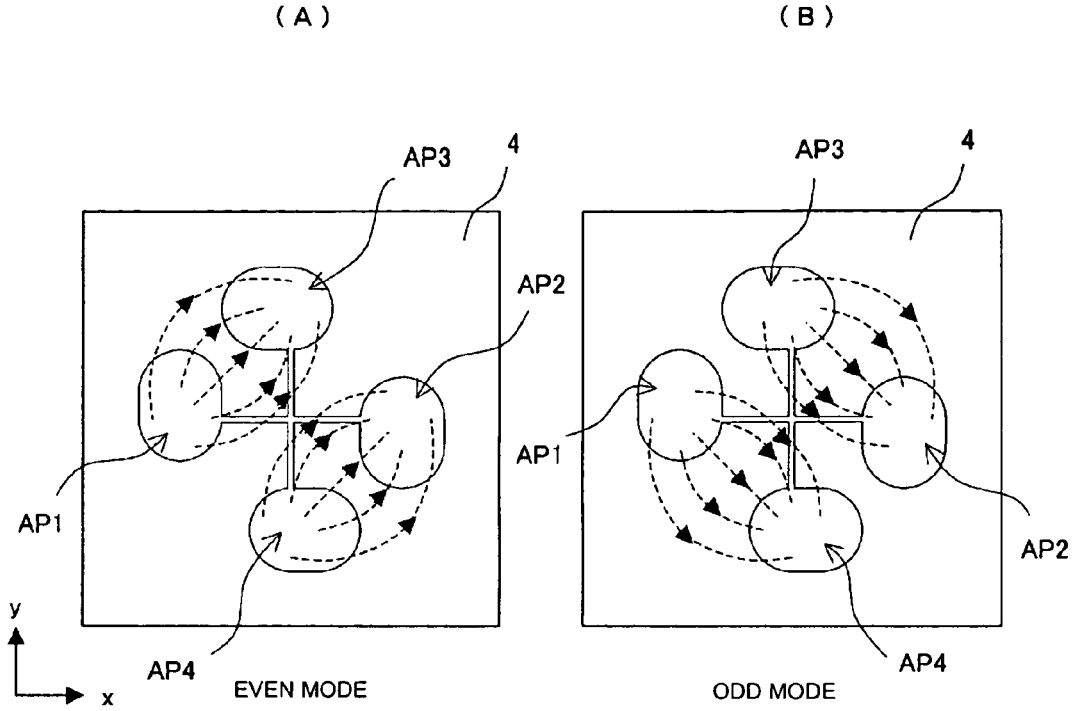
FIGS. 5(A) and 5(B) are diagrams showing two resonant modes of the resonator.
Figure 6:
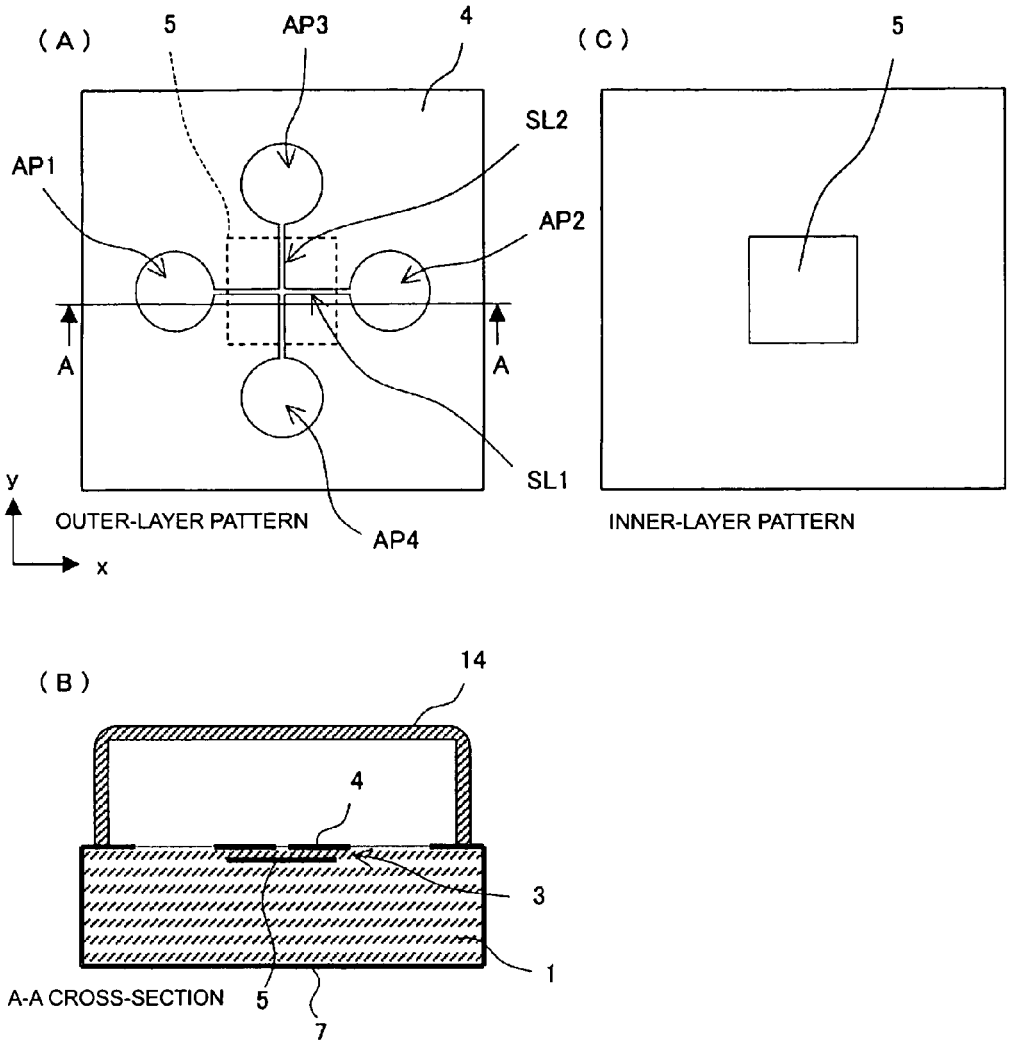
FIGS. 6(A)-6(C) are diagrams showing a structure of a resonator according to a third embodiment.
Figure 7:
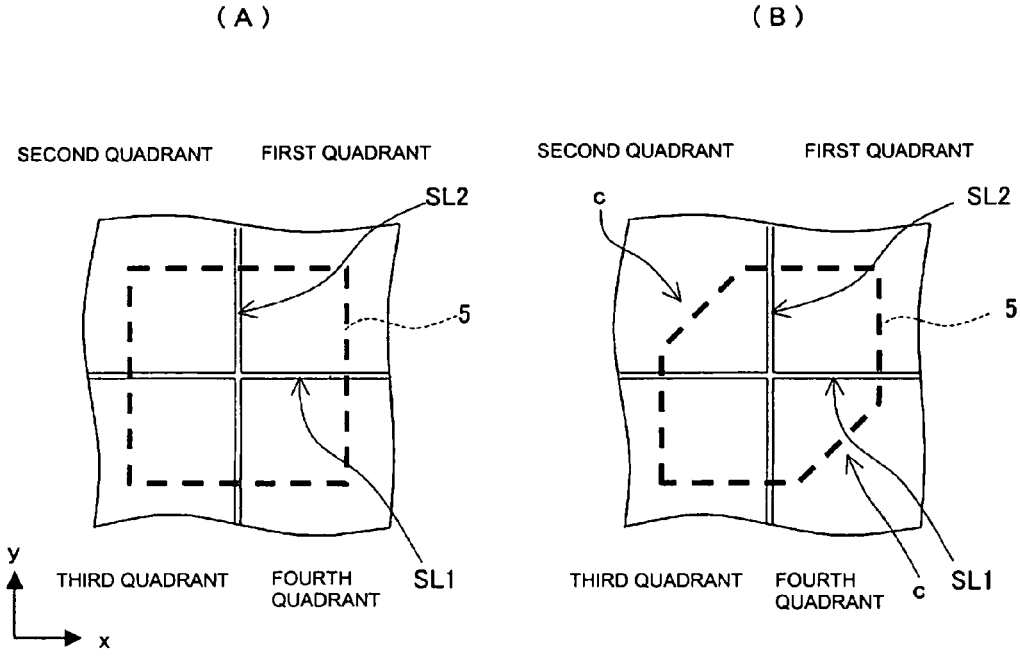
FIGS. 7(A) and 7(B) are diagrams showing the shape of a capacitance-forming conductor layer of the resonator.

A resonator according to a first embodiment will be described with reference to FIGS. 1 to 3.

FIG. 1(A) is a top view of the resonator from which a shield cap is removed, and FIG. 1(B) is a cross-sectional view taken along line A-A in FIG. 1(A) when the shield cap is attached. A conductor layer 4 having first and second conductor openings AP1 and AP2 communicating with each other via a first slit SL1 and third and fourth conductor openings AP3 and AP4 communicating with each other via a second slit SL2 is defined on the upper surface of a rectangular plate-shaped dielectric substrate 1. A shield electrode 7 is formed over five surfaces, i.e., the side surfaces and the bottom surface, of the dielectric substrate 1.

A shield cap 14 that covers an area in which the conductor openings AP1 to AP4 and the slits SL1 and SL2 are defined and that is DC-connected to the conductor layer 4 is attached to the top of the dielectric substrate 1.

FIGS. 2(A)-2(B) illustrate magnetic field distributions of two resonant modes generated by the four conductor openings AP1 to AP4 of the resonator. In FIGS. 2(A)-2(B), a broken-line arrow represents a magnetic field vector. FIG. 2(A) shows a mode (hereinafter referred to as an "even mode") in which the magnetic field vectors are directed towards the third conductor opening AP3 from the first conductor opening AP1 and in which the magnetic field vectors are directed towards the second conductor opening AP2 from the fourth conductor opening AP4. FIG. 2(B) shows a mode (hereinafter referred to as an "odd mode") in which the magnetic field vectors are directed towards the fourth conductor opening AP4 from the first conductor opening AP1 and in which the magnetic field vectors are directed towards the second conductor opening AP2 from the third conductor opening AP3.

The four conductor openings AP1 to AP4 serve as individual inductive areas, and the slits SL1 and SL2 shaped into a cross serve as capacitive areas. When the conductor openings AP1 to AP4 and the slits SL1 and SL2 have a symmetrical shape with respect to the x and y axes, the distributions of the magnetic field vectors in the even mode and the odd mode have an overlapping relation when they are geometrically rotated by 90 degrees (90-degree rotation symmetry). In this case, the two modes are degenerate (in the state where two independent resonant modes have the same resonant frequency and are uncoupled).

FIGS. 3(A)-3(D) illustrate two other resonant modes using a combination of conductor openings and slits. FIG. 3(A) is a plan view showing a magnetic field distribution of a resonant mode (hereinafter referred to as an "X mode") using conductor openings AP1 and AP2 and a slit SL1, and FIG. 3(C) is a cross-sectional view taken along line A-A of FIG. 3(A). In FIGS. 3(A) and 3(C), third and fourth conductor openings AP3 and AP4 and a second slit SL2 are not illustrated. FIG. 3(B) is a plan view showing a magnetic field distribution of a resonant mode (hereinafter referred to as a "Y mode") using conductor openings AP3 and AP4 and a slit SL2, and FIG. 3(D) is a cross-sectional view taken along line B-B of FIG. 3(B). In FIGS. 3(B) and 3(D), first and second conductor openings AP1 and AP2 and a first slit SL1 are not illustrated.

FIGS. 3(A)-3(D), a broken-line arrow represents a magnetic field vector, and dot and cross symbols represent directions of magnetic field vectors. The even and odd modes shown in FIGS. 2(A)-2(B) can be expressed in a manner in which the X and Y modes shown in FIGS. 3(A)-3(D) are coupled. In a strip-line resonator as disclosed in Non-Patent Document 1 or Patent Document 1 or 2, the magnetic field is distributed around an electrode. In this embodiment, however, most of the magnetic field vectors are distributed in the conductor openings AP1 to AP4, and are not expanded outwards in the plan-view direction from the conductor openings. This results in less leakage of energy to the outside of the resonator, which is effective in enhancing the compactness and integration of the circuit.

The resonator composed of the four conductor openings AP1 to AP4 and the two slits SL1 and SL2 defined on the conductor film 4 is shielded by the shield electrode 7 on the side of the dielectric substrate 1 and the shield cap 14. It is therefore possible to prevent the interference between the resonator and other components or circuits near the resonator.

Next, a resonator according to a second embodiment will be described with reference to FIGS. 4(A) through 5(B).

In FIG. 4(A), unlike the resonator shown in FIG. 1, the first through fourth conductor openings AP1 to AP4 are shaped into ovals, and these four conductor openings AP1 to AP4 are arranged asymmetrically with respect to the x- and y-axes. In the example shown in FIGS. 4(A)-4(B), the distance between the conductor openings AP1 and AP3 and the distance between the conductor openings AP4 and AP2 are narrower than the distance between the conductor openings AP1 and AP4 and the distance between the conductor openings AP3 and AP2.

FIG. 5(A) shows a distribution of magnetic field vectors in the even mode of the resonator, and FIG. 5(B) shows a distribution of magnetic field vectors in the odd mode. The magnetic field vectors in the even mode are directed from the conductor opening AP1 to the conductor opening AP3 and from the conductor opening AP4 to the conductor opening AP2, and the magnetic field vectors in the odd mode are directed from the conductor opening AP1 to the conductor opening AP4 and from the conductor opening AP3 to the conductor opening AP2.

As shown in FIGS. 5(A)-5(B), the even mode and the odd mode can be expressed as two overlapping resonant modes, i.e., the resonant mode (X mode) using the conductor openings AP1 and AP2 and the slit SL1 and the resonant mode (Y mode) using the conductor openings AP3 and AP4 and the slit SL2. In this case, the resonant frequencies of the X and Y modes are equal. With respect to the even mode and the odd mode, the path length of the magnetic field vectors rotated around a pair of two conductor openings is longer in the odd mode than in the even mode. Therefore, the frequency of the odd mode is higher than the frequency of the even mode. That is, in the perturbation theory, work is performed on a magnetic field distribution when the distance between the openings increases, thus accounting for the higher frequency. Further, as the distance between the openings increases, the distribution of magnetic field density is flattened and the amount of induction is reduced, thus accounting for the higher frequency.

By resolving the degeneracy, therefore, a two-stage resonator in which two resonators are coupled is provided. As discussed below, the resonator is provided with input/output means, thus forming a filter having a two-stage resonator.

Next, a structure of a resonator according to a third embodiment will be described with reference to FIGS. 6(A) through 7(B) and 24(A) to 26(B).

FIG. 6(A) is a top view of the resonator from which a shield cap is removed, FIG. 6(B) is a cross-sectional view taken along line A-A in FIG. 6(A) when the shield cap is attached, and FIG. 6(C) is a plan view showing the shape and position of a conductor layer in an inner layer of a dielectric substrate 1. As in the first embodiment, a conductor layer 4 having four conductor openings AP1 to AP4 and two slits SL1 and SL2 is defined on the upper surface of the dielectric substrate 1. A shield electrode 7 is formed over the four side surfaces of the dielectric substrate 1 and the four side surfaces and the bottom surface of the dielectric substrate 1. The inner layer of the dielectric substrate 1 further includes a capacitance-forming conductor layer 5. The capacitance-forming conductor layer 5 is disposed at a position facing, with an insulating layer 3 therebetween, four sections of the conductor layer 4 that is sectioned by intersecting the first slit SL1 and the second slit SL2. A capacitance is generated between the capacitance-forming conductor layer 5 and the conductor layer 4. Thus, the capacitive area between the capacitance-forming conductor layer 5 and the conductor layer 4 with the insulating layer 3 therebetween is larger than that when only the slits SL1 and SL2 are provided.

The capacitance-forming conductor layer 5 allows an increase in the capacitance of the capacitive area, and, accordingly, allows a reduction in the size of the resonator for obtaining the desired resonant frequency.

FIG. 7(A) shows the four sections of the conductor layer 4 sectioned by the intersecting first and second slits SL1 and SL2 at a position at which the capacitance-forming conductor layer 5 is defined. When the four sections are represented by first to fourth quadrants, the directions of the electric field vectors in the even mode and the odd mode have the following relation:

TABLE 1

| | quadrant | | | |
|---|---|---|---|---|
| mode | first | second | third | fourth |
| even mode | 0 | − | 0 | + |
| odd mode | + | 0 | − | 0 |

Table 1 shows the directions of the electric field vectors at certain time. In Table 1, the + (plus) symbol represents upward, the − (minus) symbol represents downward, and the numeral 0 represents 0 as the average. As shown in FIG. 7(A), when the capacitance-forming conductor layer 5 is 90°-rotation-symmetric (vertically and horizontally symmetric) with respect to the two slits SL1 and SL2 as the axes of symmetry, the capacitance-forming conductor layer 5 acts as a capacitive area having an equal capacitance in the even mode and the odd mode. For example, as shown in FIG. 7(B), the capacitance-forming conductor layer 5 is formed with cutout portions so that the dimension of the capacitance-forming conductor layer 5 is reduced in the second and fourth quadrants to reduce the capacitance in the second and fourth quadrants. In this case, the capacitance in an area in which the electric field energy in the even mode is concentrated decreases without affecting the odd mode. As a result, the frequency of the even mode becomes higher than that of the odd mode.

FIGS. 24(A)-24(D) and 25(A)-25(D) illustrate a magnetic field distribution and an electric field distribution of the resonator including the capacitance-forming conductor layer 5 shown in FIG. 7(B). For easy simulation, the four conductor openings AP1 to AP4 are illustrated such that the AP1-AP2 direction and the AP3-AP4 direction are shifted by an angle of ±45°. FIGS. 24(A) and 24(B) show a mode in which the magnetic field vectors are directed from the conductor opening AP1 to the conductor opening AP4 and from the conductor opening AP3 to the conductor opening AP2 (i.e., the odd mode described above). In FIG. 24(A), the intensity of the magnetic field energy is represented by an aggregate of fine dot patterns. In FIG. 24(B), an arrow and dot and cross symbols represent directions of the magnetic field vectors. FIGS. 25(A) and 25(B) show electric field distributions of the above-described mode. In FIG. 25(A), the intensity of the electric field energy is represented by an aggregate of fine dot patterns. In FIG. 25(B), dot and cross symbols represent directions of the electric field vectors.

Likewise, FIGS. 24(C), 24(D), 25(C), and 25(D) show the even mode. As is apparent from FIGS. 25(A)-25(D), in this example, the electric field of the even mode is affected by the cutout portions c of the capacitance-forming conductor layer 5, and the frequency increases to 3.40 GHz. The electric field of the odd mode, on the other hand, is not affected by the cutout portions c of the capacitance-forming conductor layer 5, and the frequency is maintained at 3.04 GHz.

Therefore, if the four conductor openings AP1 to AP4 and the two slits SL1 and SL2 are 90°-rotation-symmetric (vertically and horizontally symmetric), the degeneracy can be resolved to couple the X mode and the Y mode.

FIGS. 26(A)-26(C) are diagrams comparing the resonator according to the third embodiment with a strip-line resonator of the related art. FIG. 26(A) shows the resonator of this embodiment, and FIG. 26(B) shows the resonator of the related art. In FIGS. 26(A) and 26(B), an area in which two magnetic field vectors intersect is surrounded by a circle. The resonator of the present invention includes a lumped-constant resonant circuit, and is more effective in reducing the pattern size. For example, when the relative dielectric constant of the dielectric substrate is 30 (the effective relative dielectric constant of MSL is 15), the half-wavelength at 3 GHz has a length a of about 13 mm. In this embodiment, in contrast, one side has a length a' of 2.8 mm, and the size can be reduced to about ⅕ (in terms of the dimension, to about 1/25).

Further, as discussed below, due to the characteristics of the electromagnetic field distribution of the resonant modes, the proportion of an area in which a circularly polarized wave is generated is large.

Figure 8:
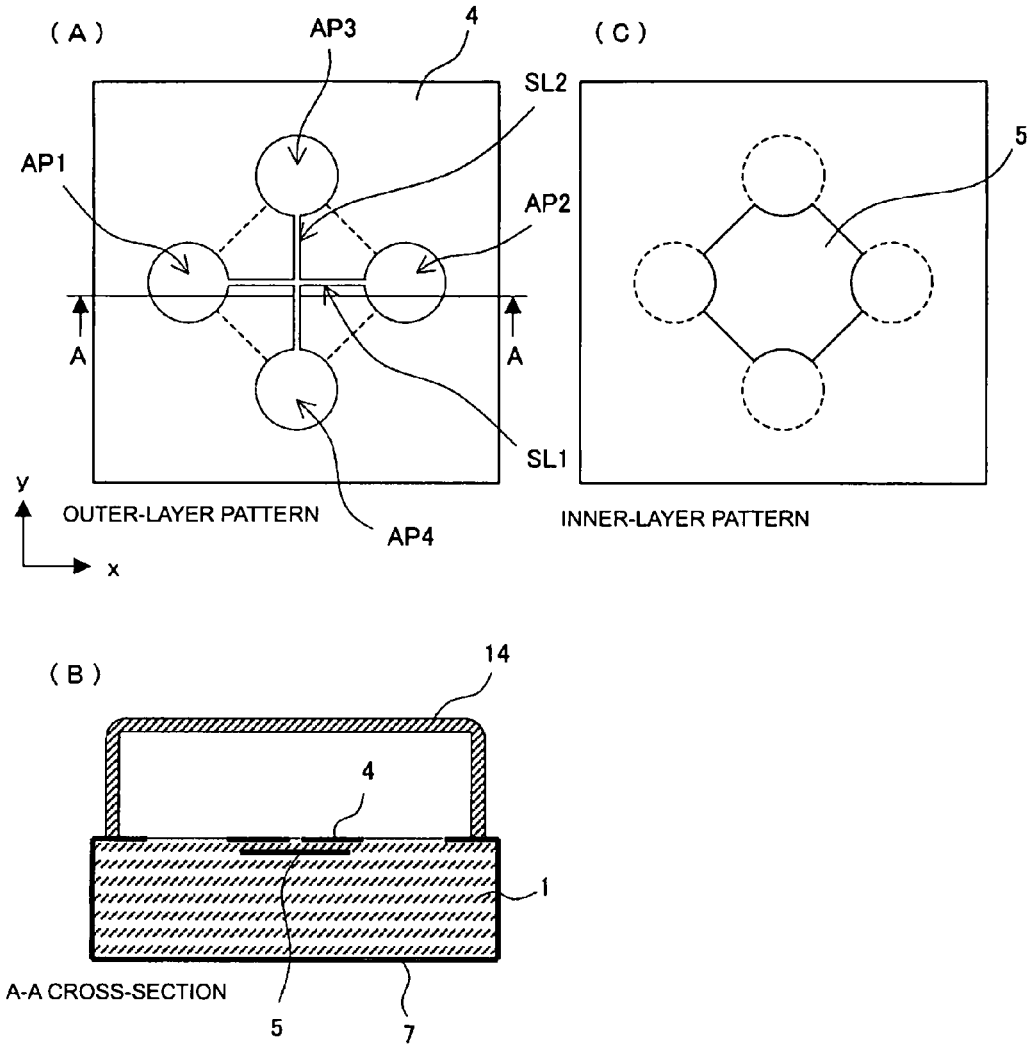
FIGS. 8(A)-8(C) are diagrams showing a structure of a resonator according to a fourth embodiment.

FIGS. 8(A)-8(C) illustrate a structure of a resonator according to a fourth embodiment. FIG. 8(A) is a top view of the resonator from which a shield cap is removed, FIG. 8(B) is a cross-sectional view taken along line A-A in FIG. 8(A) when the shield cap is attached, and FIG. 8(C) is a plan view showing the shape and position of a conductor layer in an inner layer of a dielectric substrate 1. Unlike the example shown in FIGS. 6(A)-6(C), the capacitance-forming conductor layer 5 is large enough to be immediately close to the conductor openings AP1 to AP4. The other portions are similar to those of the resonator shown in FIGS. 6(A)-6(C). In this manner, the capacitance-forming conductor layer 5 is defined in a larger area, resulting in an increase in the capacitance of the capacitive area, and a lower frequency and a further reduction in size are achieved accordingly.

Figure 9:
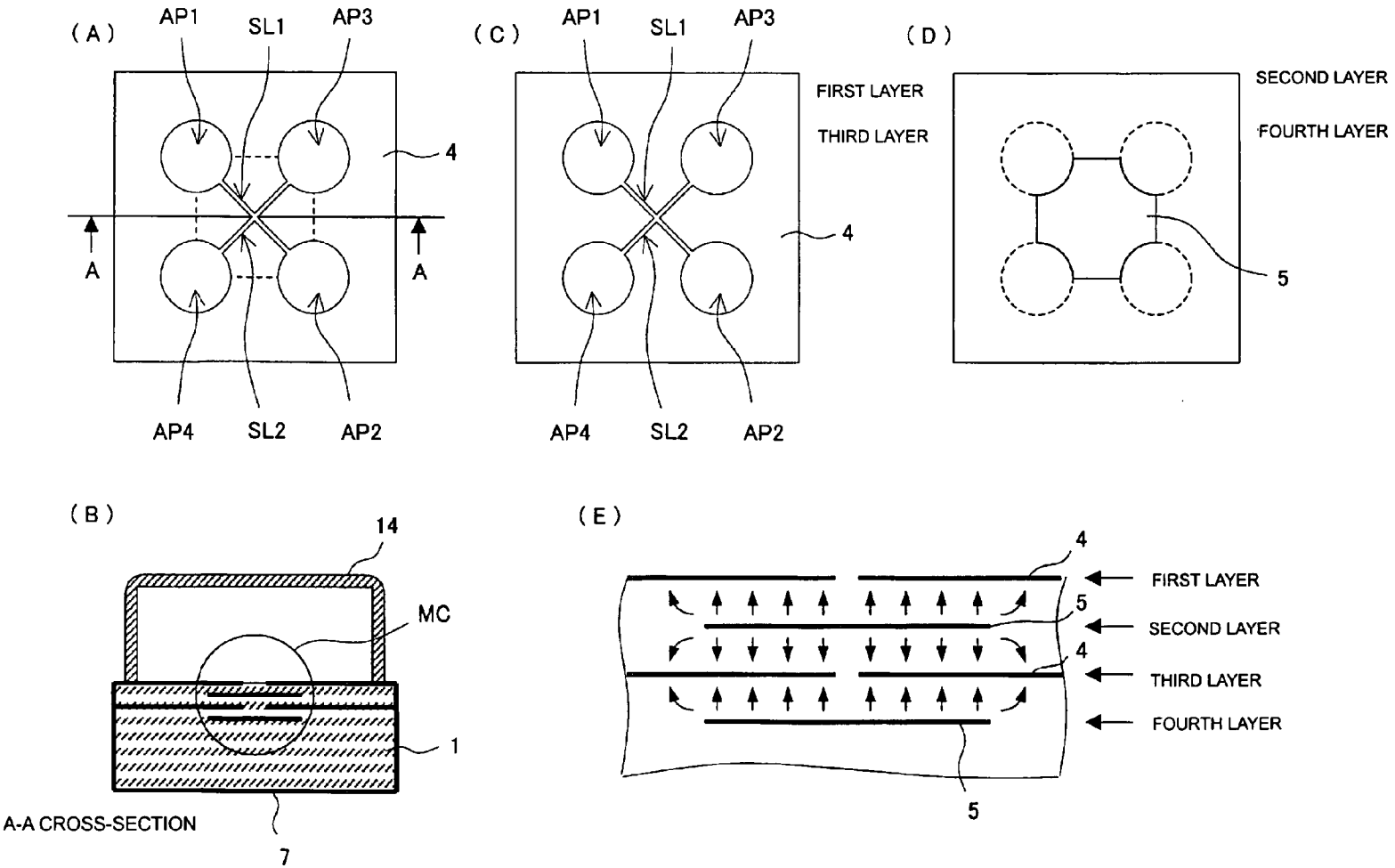
FIGS. 9(A)-9(E) are diagrams showing a structure of a resonator according to a fifth embodiment.

FIGS. 9(A)-9(E) illustrate a structure of a resonator according to a fifth embodiment. FIG. 9(A) is a top view of the resonator from which a shield cap is removed, and FIG. 9(B) is a cross-sectional view taken along line A-A in FIG. 9(A) when the shield cap is attached. If conductor layers defined on the dielectric substrate 1 are represented by a first layer, a second layer, a third layer, . . . , in order from the top thereof, FIG. 9(C) shows a conductor layer pattern in the odd-numbered layers (the first layer, the third layer, . . . ). FIG. 9(D) shows a pattern of a capacitance-forming conductor layer 5 in the even-numbered layers (the second layer, the fourth layer, . . . ). FIG. 9(E) shows a directions and distribution of electric field vectors between the conductor layers up to the fourth layer among the plurality of layers. Also in FIG. 9(B), the layers up to the fourth layer are illustrated.

By alternately laminating the conductor layers having the conductor openings AP1 to AP4 and the slits SL1 and SL2 and the capacitance-forming conductor layers 5, a large capacitance can be formed in the limited space (volume). Therefore, a lower frequency and a reduction in size are achieved.

Figure 10:
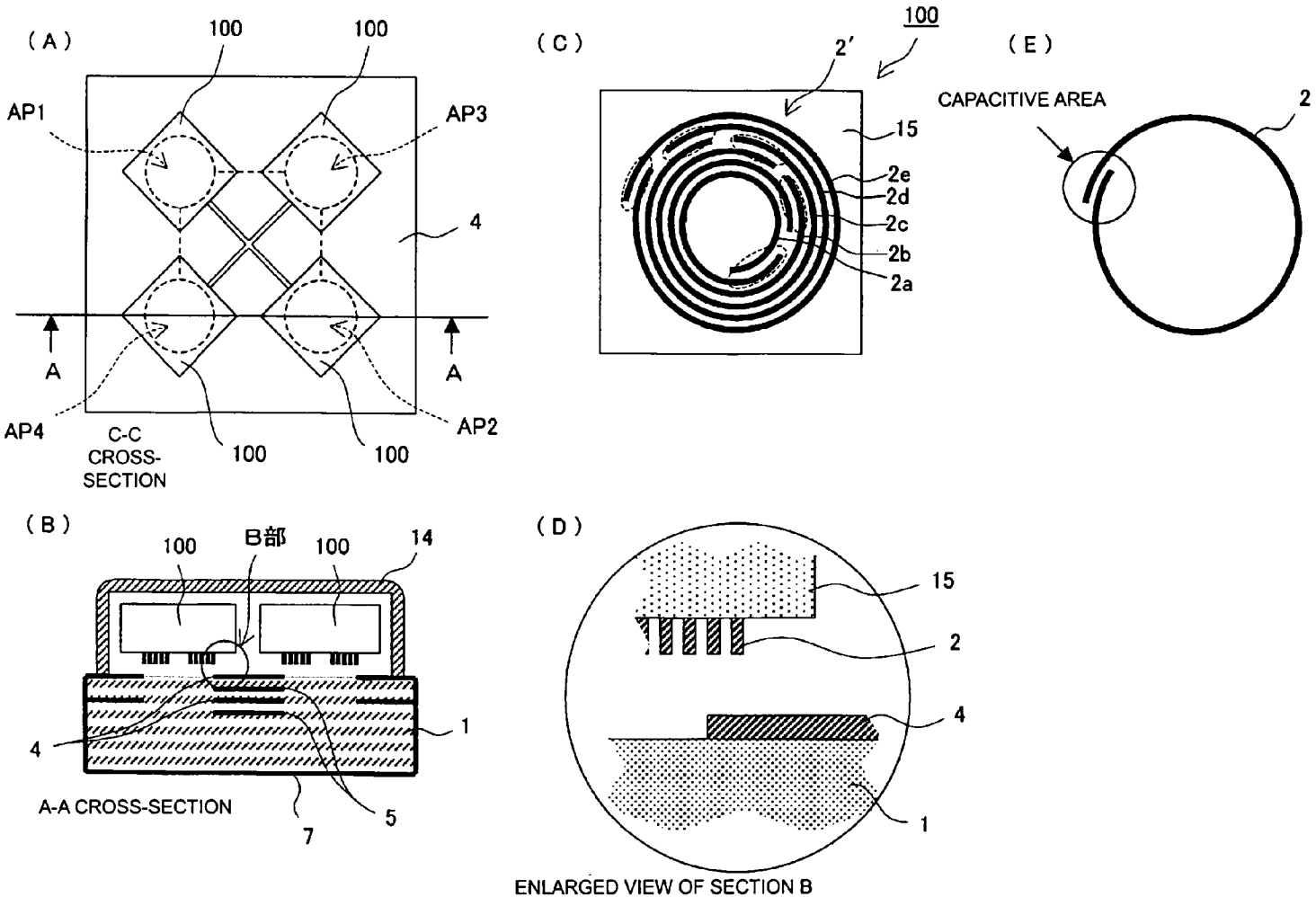
FIGS. 10(A)-10(E) are diagrams showing a structure of a resonator according to a sixth embodiment.

FIGS. 10(A)-10(E) illustrate a structure of a resonator according to a sixth embodiment. FIG. 10(A) is a top view of the resonator from which a shield cap is removed, and FIG. 10(B) is a cross-sectional view taken along line A-A in (A) when the shield cap is attached. FIG. 10(C) is a plan view of a resonant element used in the resonator on a conductor-line-forming surface. FIG. 10(D) is an enlarged partial cross-sectional view of a section B in FIG. 10(B). FIG. 10(E) is an illustration of a pattern of a conductor line formed on a resonant element 100.

Similar to the resonator shown in FIGS. 9(A)-9(E), conductor layers 4 are disposed in the odd-numbered layers of a dielectric substrate 1, and capacitance-forming conductor layers 5 are disposed in the even-numbered layers. In the example shown in FIGS. 10(A)-10(E), the resonant element 100 is mounted on the top of each of four conductor openings AP1 to AP4.

As shown in FIG. 10(C), the resonant element 100 includes a conductor line aggregate 2' on one principal surface of a rectangular plate-shaped substrate 15. As indicated by broken elliptic lines in FIG. 10(C), the conductor line aggregate 2' includes conductor lines 2*a*, 2*b*, 2*c*, 2*d*, and 2*e* each having ends adjacent to each other in the width direction. The sections indicated by the broken elliptic lines correspond to capacitive areas of a step-ring resonant element, which will be described below. In this example, the conductor lines 2*a*, 2*b*, 2*c*, 2*d*, and 2*e* are arranged so that a leading end of each conductor line faces a leading end of another conductor line adjacent thereto with a predetermined distance therebetween.

One resonance unit among the conductor lines 2*a*, 2*b*, 2*c*, 2*d*, and 2*e* will now be described with reference to FIGS. 11(A)-11(C).

Figure 11:
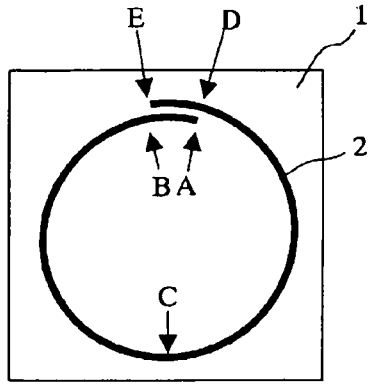
FIGS. 11(A)-11(C) are diagrams showing the operation of a resonant element used in the resonator.
Figure 11:
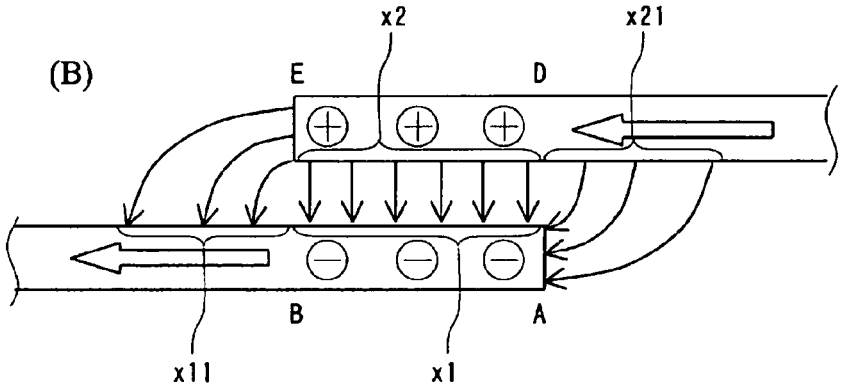
Figure 11:
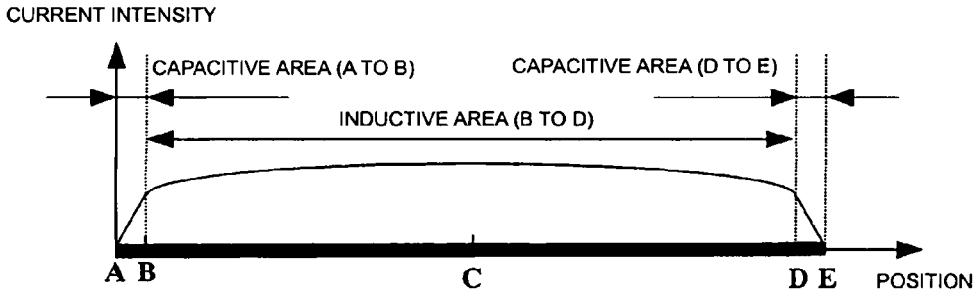

FIG. 11(A) is a plan view of one resonance unit. FIG. 11(B) shows an electric field distribution at a portion in which both ends of a conductor line 2 are adjacent to each other. FIG. 11(C) shows a distribution of current in the conductor line.

The conductor line 2 wraps around itself one or more times with intervals of a constant width on the dielectric substrate 1, and both ends of the conductor line 2 are adjacent to each other in the width direction of the conductor line.

In FIG. 11(B), a solid-line arrow represents an electric field vector, and a hollow arrow represents a current vector. As shown in FIG. 11(B), an electric field is concentrated in a portion in which both ends x1 and x2 of the conductor line are adjacent to each other in the width direction. Also between one leading end of the conductor line and the other near-end portion x11 adjacent thereto and between the other leading end and the other near-end portion x21 adjacent thereto, an electric field is distributed and a capacitance is generated.

With regard to the distribution of current, as shown in FIG. 11(C), the current intensity rapidly increases from point A to point B of the conductor line, and is maintained at a substantially constant value in the region from point B to point D, and rapidly decreases from point D to point E. The values at both ends are 0. The regions A to B and D to E in which both ends of the conductor line are adjacent to each other in the width direction can be referred to as a capacitive area, and the remaining region B to D can be referred to as an inductive area. The capacitive area and the inductive area are used to perform a resonance operation. The resonance unit, when regarded as a lumped-constant circuit, forms an LC resonant circuit.

The resonance unit is composed of an inductive area with high impedance, and a capacitive area with low impedance, and the impedance changes stepwise. The resonance unit is therefore referred to as a step ring. A resonant element is composed of a plurality of resonance units, and is referred to as a multi-step-ring resonant element.

As such, an aggregate of the conductor lines 2 having a large number of lines is arranged in the limited space to form conductor lines having a large number of lines, and a compact resonator is formed. By rendering the line width of the fine electrode of the step ring resonant element smaller than the skin depth at the operating frequency, the loss reduction effect due to reduced skin effect can be achieved.

Figure 12:
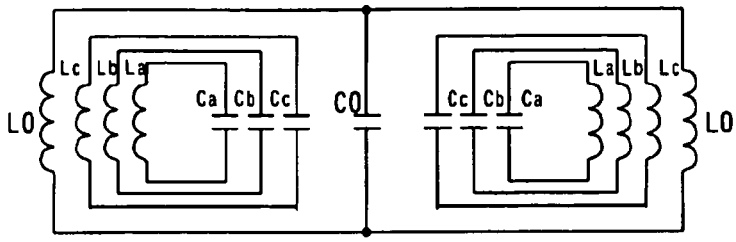
FIGS. 12(A) and 12(B) are equivalent circuit diagrams of the resonant element used in the resonator.
Figure 12:
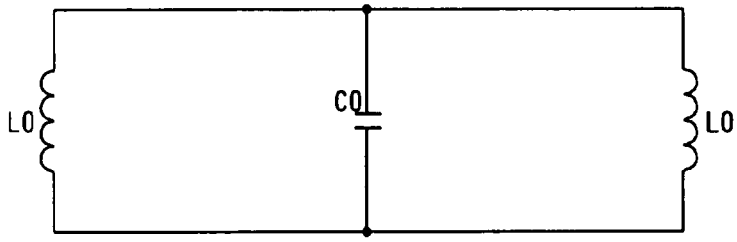

FIGS. 12(A)-12(B) are equivalent circuit diagrams of the resonant element 100 shown in FIGS. 10(A)-10(E). FIG. 12(B) shows an equivalent circuit of a slot resonator including a conductor film 4 having conductor openings AP1 to AP4 and slits SL1 and SL2 without forming the conductor lines 2*a*, 2*b*, and 2*c* shown in FIG. 10. When the inductive area formed of the conductor openings AP1 to AP4 is represented by an inductor Lo and the capacitive area formed of the slits SL1 and SL2 is represented by a capacitor C0, as shown in FIG. 12(B), the resonator acts as an LC parallel resonant circuit when regarded as a lumped-constant circuit.

The resonance units formed of the conductor lines 2*a* to 2*e* shown in FIG. 10(C) are each configured such that a capacitive area and an inductive area are connected into a ring. If each resonance unit is represented by a parallel circuit including a capacitor and an inductor, the equivalent circuit of the overall resonator is illustrated in FIG. 12(A).

Thus, a multi-step-ring resonant element is placed inside a conductor opening serving as an inductive area of a slot resonator, whereby the current concentration at the edges of the conductor opening serving as an inductive area can be mitigated to suppress the conductor loss. Further, by rendering the width and line interval of the conductor lines of the multi-step-ring resonant element equal to or less than the skin depth of the conductor and increasing the number of lines, the conductor loss due to the edge effect can entirely be reduced.

In the example shown in FIG. 10(B), each of the conductor openings is provided with the resonant element 100. However, only a predetermined conductor opening, rather than all conductor openings AP1 to AP4, may be provided with the resonant element 100.

Next, a structure of a filter according to a seventh embodiment of the present invention will be described with reference to FIGS. 13(A)-13(F).

Figure 13:
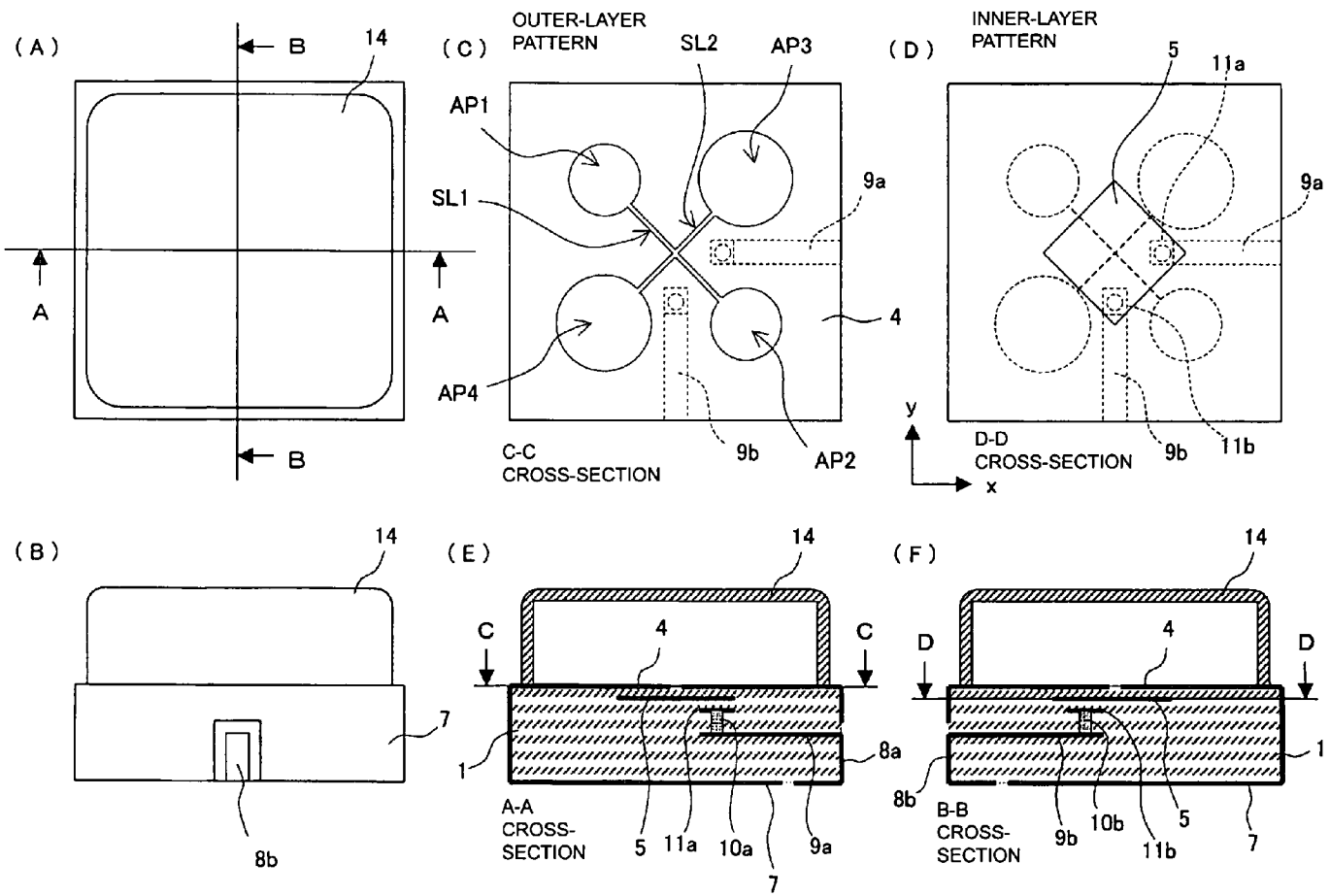
FIGS. 13(A)-13(F) are diagrams showing a structure of a resonator according to a seventh embodiment.
Figure 14:
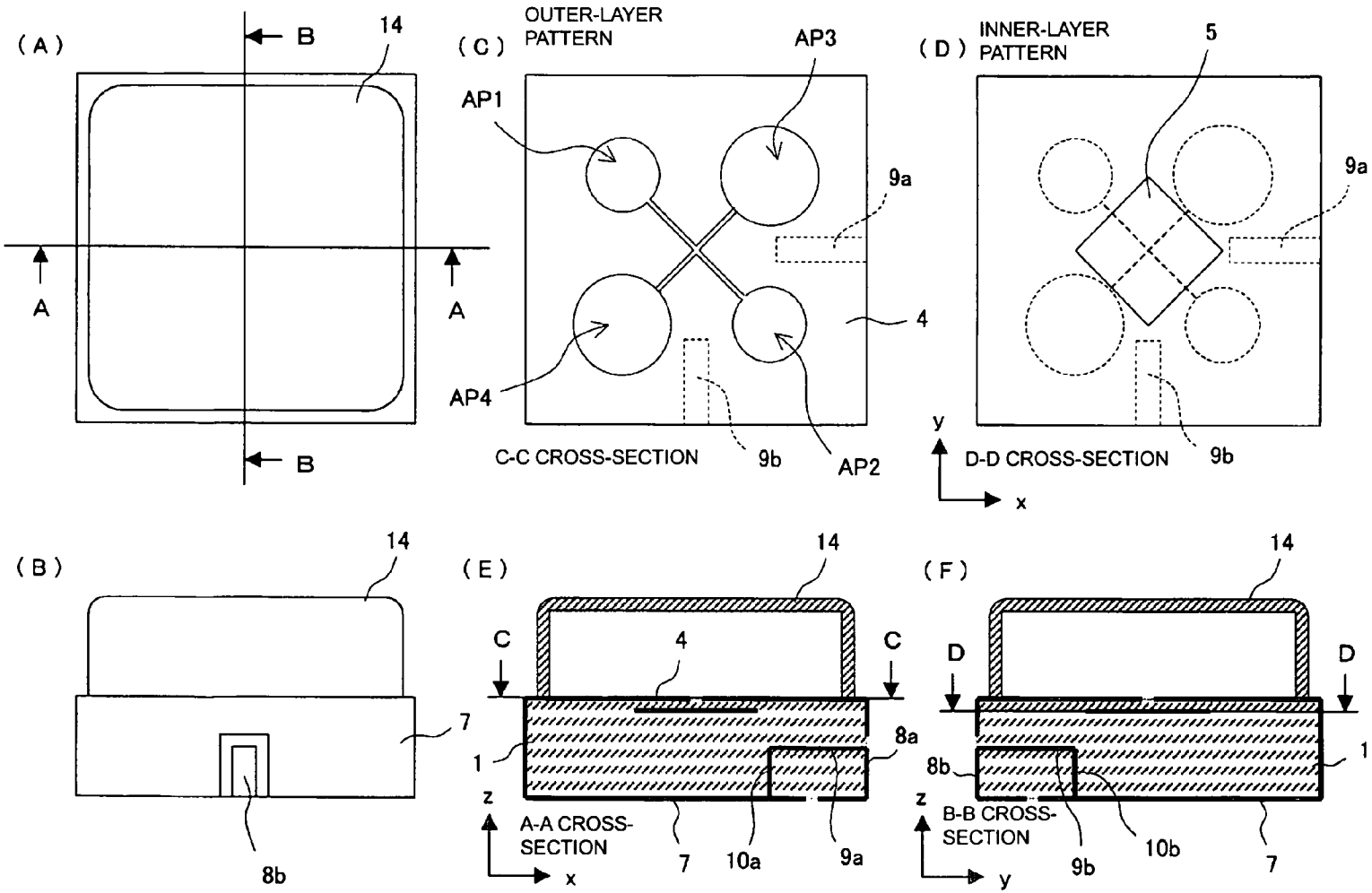
FIGS. 14(A)-14(F) are diagrams showing a structure of a resonator according to an eighth embodiment.

FIG. 13(A) is a top view of the filter, and FIG. 13(B) is a front view thereof. FIG. 13(E) is a cross-sectional view taken along line A-A in FIG. 13(A), and FIG. 13(F) is a cross-sectional view taken along line B-B in FIG. 13(A). FIG. 13 (C) is a plan view of a C-C cross-section in FIG. 13(E), and FIG. 13(D) is a plan view of a D-D cross-section in FIG. 13(F).

A conductor layer 4 including four conductor openings AP1 to AP4 and two slits SL1 and SL2 is defined on the upper surface of a dielectric substrate 1. In this example, the pair of conductor openings AP3 and AP4 is larger than the pair of conductor openings AP1 and AP2 so as to provide 90-degree rotation asymmetry. Therefore, the frequencies of a mode in which magnetic field vectors are directed in the (x+y)-axis direction and a mode in which magnetic fields are directed in the (x−y)-axis direction differ, and a mode in which magnetic field vectors are directed in the x-axis direction and a mode in which magnetic field vectors are directed in the y-axis direction are coupled.

As in the illustration of FIG. 6(B), a capacitance-forming conductor layer 5 is placed at a position facing four sections of the conductor layer 4 that is sectioned by the intersecting first and second slits SL1 and SL2.

Inside the dielectric substrate 1, beneath the capacitance-forming conductor layer 5, there are provided capacitance-coupling electrodes 11*a* and 11*b* for generating a capacitance between the capacitance-coupling electrodes 11*a* and 11*b* and the capacitance-forming conductor layer 5, via-holes 10*a* and 10*b* brought into connection with the capacitance-coupling electrodes 11*a* and 11*b*, and input/output-coupling electrodes 9*a* and 9*b* brought into connection with the via-holes 10*a* and 10*b*.

An input/output terminal 8 brought into connection with the input/output-coupling electrode 9 is formed over the side surfaces and the bottom surface of the dielectric substrate 1. As shown in FIGS. 13(C) to 13(F), the capacitance-coupling electrode 11*a* is capacitively coupled to the capacitance-forming conductor layer 5 at a position displaced from the center of the capacitance-forming conductor layer 5 towards the x-axis direction, and the capacitance-coupling electrode 11*b* is capacitively coupled to the capacitance-forming conductor layer 5 at a position displaced from the center of the capacitance-forming conductor layer 5 towards the y-axis direction. Therefore, the input/output terminal 8*a*, the input/output-coupling electrode 9*a*, the via-hole 10*a*, and the capacitance-coupling electrode 11*a* are coupled to a resonant mode in which magnetic field vectors are directed in the y-axis direction. Likewise, the input/output terminal 8*b*, the input/output-coupling electrode 9*b*, the via-hole 10*b*, and the capacitance-coupling electrode 11*b* are coupled to a resonant mode in which magnetic field vectors are directed in the x-axis direction.

In FIGS. 6(A) and 7(A)-7(B), the directions in which the two slits SL1 and SL2 extend are denoted by the x- and y-axis directions. In the example shown in FIGS. 13(A)-13(F), however, the axes that lie in the plane perpendicular to a z-axis (the axis orthogonal to the x- and y axes) and that are rotated by 45 degrees with respect to the axes shown in FIGS. 6(A)-6(C) and 7(A)-7(B) are denoted by the x- and y-axes.

With this structure, the filter acts as a band-pass filter including the input/output terminals 8*a* and 8*b* serving as input/output units and a two-stage resonator.

FIGS. 14(A)-14(F) are diagrams showing a structure of a filter according to an eighth embodiment. What is different from the example shown in FIGS. 13(A)-13(F) is the section of input/output means. In the example shown in FIGS. 14(C)-14(E), an input/output-coupling electrode 9*a* extending in the x-axis direction from an input/output terminal 8*a* defined on a side surface of the dielectric substrate 1, and a via-hole 10*a* that extends in the z-axis direction from an end of the input/output-coupling electrode 9*a* and that is brought into connection with a shield electrode 7 defined on the bottom surface are provided. Further, an input/output-coupling electrode 9*b* extending in the y-axis direction from an input/output terminal 8*b* defined on another side surface of the dielectric substrate 1, and a via-hole lob that extends in the Z-axis direction from an end of the input/output-coupling electrode 9*b* and that is brought into connection with the shield electrode 7 defined on the bottom surface are provided. The input/output-coupling electrode 9*a* and the via-hole 10*a*, whose loop surfaces, together with the input/output terminal 8*a*, are parallel to the x-z plane, are magnetic-field coupled to a resonant mode in which magnetic field vectors are directed in the y-axis direction. The input/output-coupling electrode 9*b* and the via-hole 10*b*, whose loop surfaces, together with the input/output terminal 8*b*, are parallel to the y-z plane, are magnetic-field coupled to a resonant mode in which magnetic field vectors are directed in the x-axis direction.

With this structure, the filter acts as a band-pass filter including the input/output terminals 8*a* and 8*b* serving as input/output units and a two-stage resonator.

Next, a structure of an isolator according to a ninth embodiment will be described with reference to FIGS. 15(A)-15(F) and 21(A) to 23.

Figure 15:
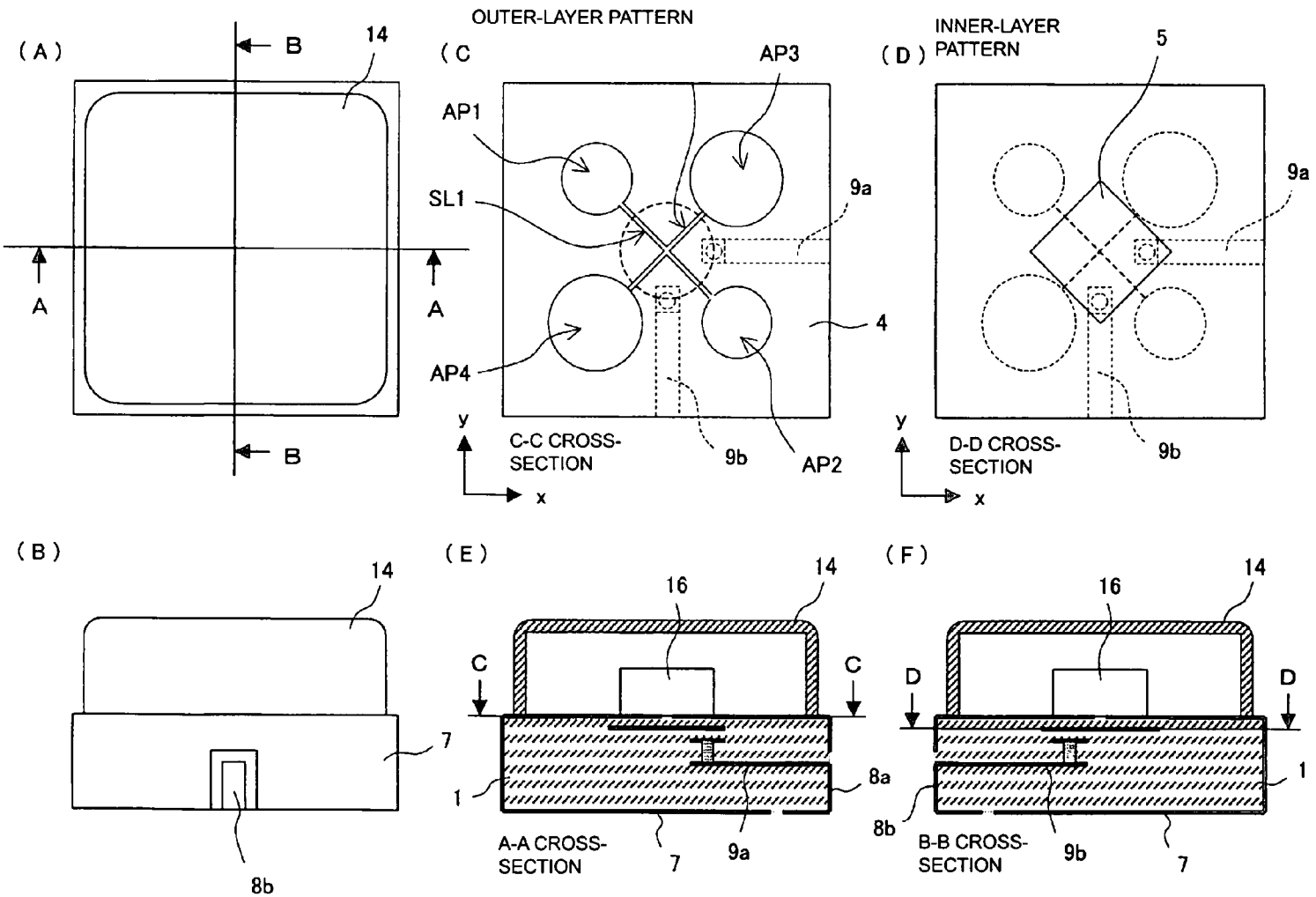
FIGS. 15(A)-15(F) are diagrams showing a structure of a resonator according to a ninth embodiment.

FIG. 15(A) is a top view of the filter, and FIG. 15(B) is a front view thereof. FIG. 15(E) is a cross-sectional view taken along line A-A in FIG. 15(A), and FIG. 15(F) is a cross-sectional view taken along line B-B in FIG. 15 (A). FIG. 15(C) is a plan view of a C-C cross-section in FIG. 15(E), and FIG. 15(D) is a plan view of a D-D cross-section in FIG. 15(F).

Inside a shield cap 14, a disk-shaped ferrite core 16 is placed on the top of a dielectric substrate 1 so as to be centered on the central portion of a region in which four conductor openings AP1 to AP4 are defined (the intersection of two slits SL1 and SL2 formed into a cross shape). The other portions are similar to those of the resonator shown in FIGS. 13(A)-13(F). Therefore, the frequencies of a mode in which magnetic field vectors are directed in the (x+y)-axis direction and a mode in which a magnetic field is directed in the (x−y)-axis direction differ, and two modes, i.e., a mode in which magnetic field vectors are directed in the x-axis direction and a mode in which magnetic field vectors are directed in the y-axis direction, are coupled. Since the directions of input/output-coupling electrodes 9*a* and 9*b* are orthogonal, the electromagnetic field generated by the two modes forms a circularly polarized wave in a region in which a capacitance-forming conductor layer 5 is defined (see FIG. 26(A)).

A direct-current magnetic field is applied to the ferrite core 16 from the outside in the direction perpendicular to the dielectric substrate 1 and the principal surface of the ferrite core 16 (by, for example, a permanent magnet placed outside the shield cap 14).

FIGS. 21(A)-21(C) illustrate a crossing angle of magnetic field vectors in two resonant modes that are degenerate. FIG. 21(A) is a plan view of the isolator, and FIGS. 21(B) and 21(C) are diagrams showing the crossing angle in the x-axis direction shown in FIG. 21(A), in which the x-coordinate ranges from −2 to +2 in FIG. 21(B) and from −0.2 to +0.2 in FIG. 21(C). With respect to a z-axis (height) direction, the measurement was performed at four levels with a step of 0.1 mm up to 0.3 mm from the position (z=0) of an electrode layer 4 on the surface, and the crossing angle is represented by the average of the four points. The crossing angle on the x-axis is substantially 90 degrees. The farther from the x-axis, the more the crossing angle is deviated from 90 degrees. However, it is found that, in the range of $-0.2 \leqq x \leqq +0.2$ (in FIG. 21(A), the area surrounded by broken lines S), the crossing angle is distributed in the range of 60 to 120 degrees. By placing the ferrite core in this area, therefore, a high isolation characteristic due to the magnetic resonance absorption of the circularly polarized wave is achieved.

FIGS. 22(A)-22(C) also illustrate a crossing angle of magnetic field vectors in two resonant modes. FIG. 22(A) is a top view of the resonator, FIG. 22(B) is a cross-sectional view of an x-z plane, and FIG. 22(C) shows the crossing angle at four positions on the x-axis with respect to z=0 to 1.5. That is, the dependency of the crossing angle of the magnetic field vectors in dual degenerate modes in the height direction (z-coordinate) is illustrated. The measurement was performed at four levels with a step of 0.1 mm up to 0.3 mm from the origin of the x-coordinate while the y-coordinate is constant at 0. The variations in the graph result from mesh coarseness in a finite element analysis. It is found that a crossing angle close to 90 degrees is obtained in the range from the bottom surface to the top surface, wherein z=0 represents the bottom surface and z=1.5 represents the upper surface. As can be seen, therefore, it is effective in all ranges from the bottom surface to the top surface to place the ferrite core in the height direction.

Figure 23:
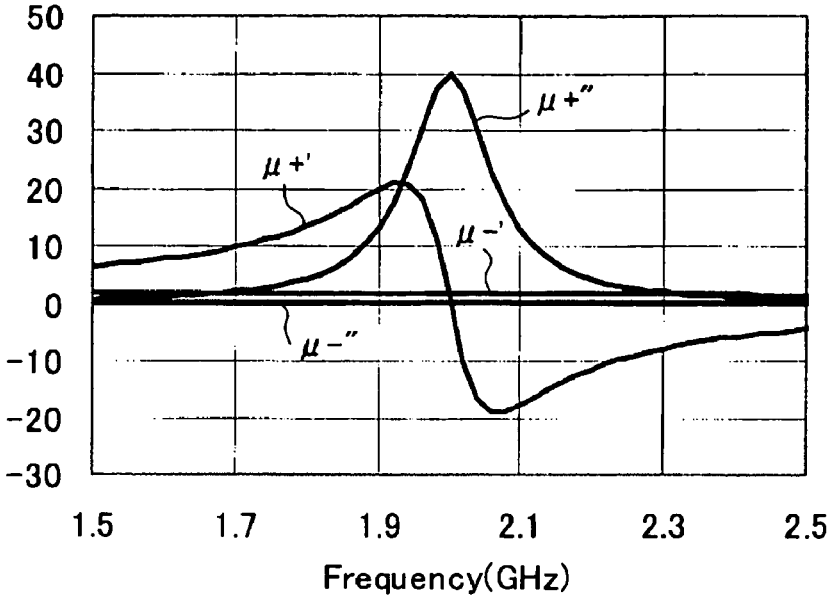
FIG. 23 is a diagram showing magnetic resonance absorption.
Figure 24:
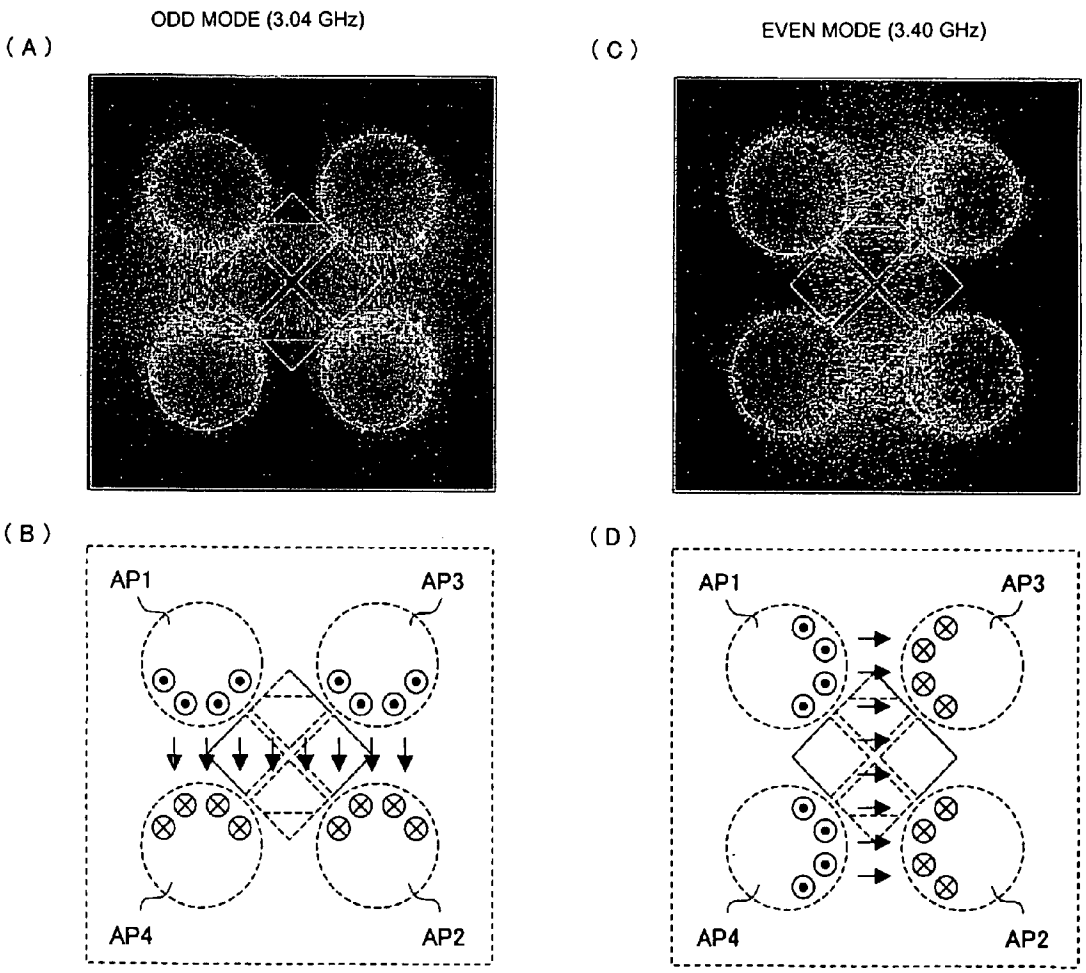
FIGS. 24(A)-24(D) are diagrams showing magnetic field distributions of the odd mode and the even mode of the resonator according to the third embodiment.
Figure 25:
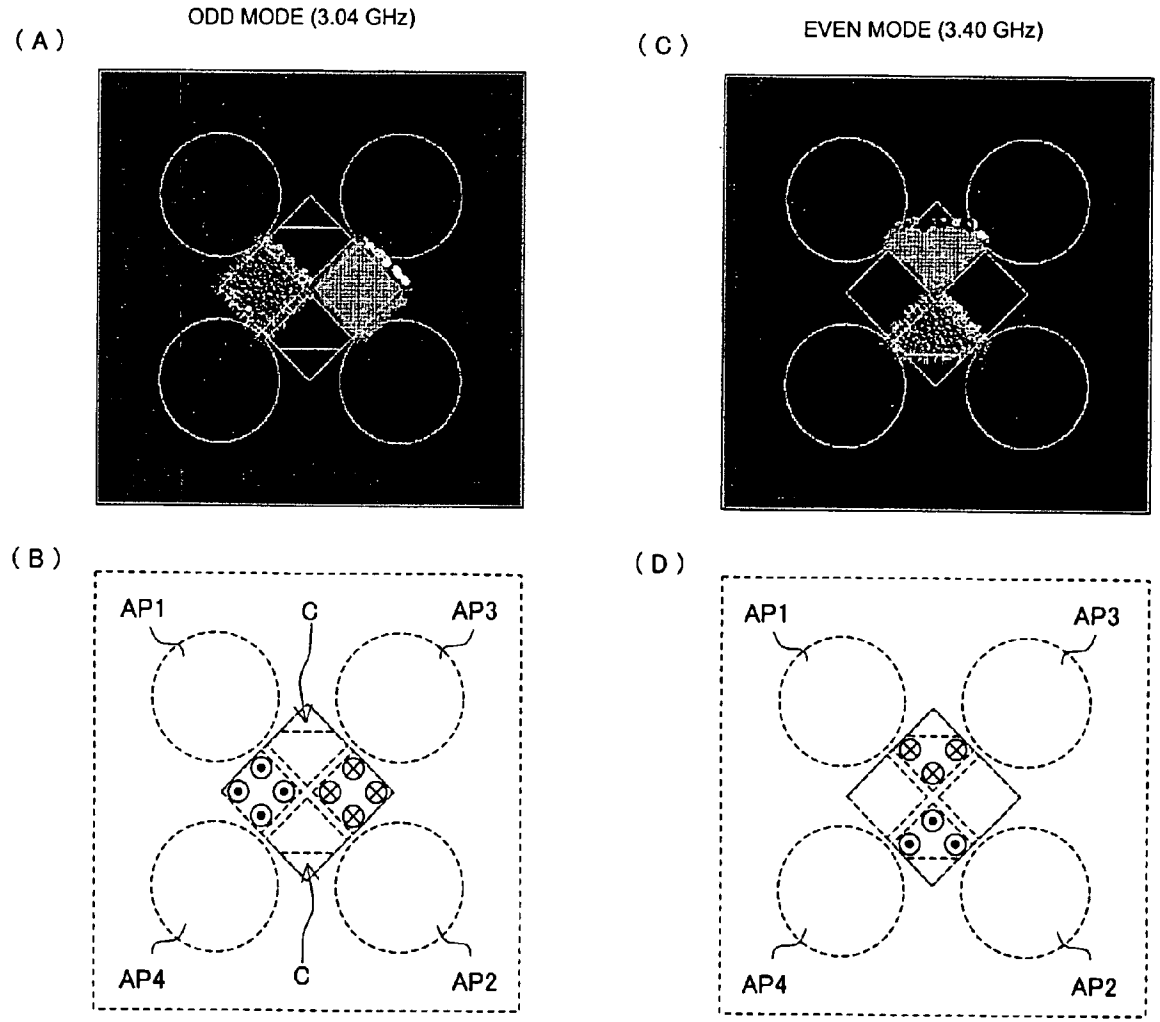
FIGS. 25(A)-25(D) are diagrams showing electric field distributions of the odd mode and the even mode of the resonator according to the third embodiment.
Figure 26:
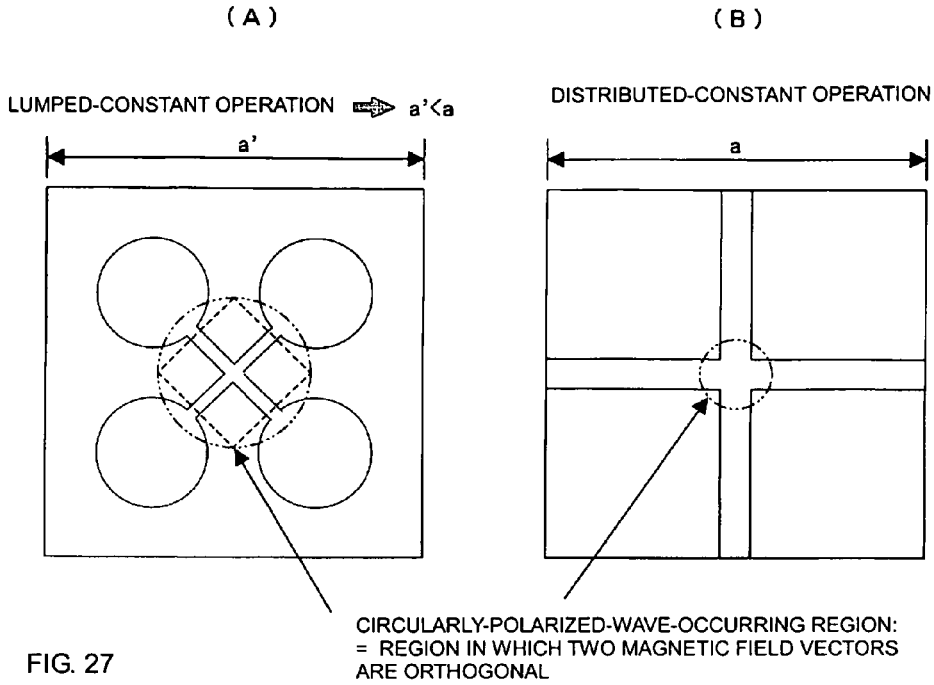
FIGS. 26(A) and 26(B) are diagrams showing a relationship between the resonator and a microstrip-line resonator of the related art.

FIG. 23 illustrates a frequency characteristic of the magnetic resonance absorption at high frequencies by applying a direct-current magnetic field to a magnetic body. When a direct-current magnetic field is applied to a magnetic body, high-frequency magnetic resonance absorption occurs, and the frequency at which the magnetic resonance absorption occurs is determined based on the magnitude of the direct-current magnetic field. The circularly polarized wave includes a positive circularly polarized wave (right-handed circularly polarized wave) and a negative circularly polarized wave (left-handed circularly polarized wave) depending on the rotational direction of the plane of polarization, and the respective complex permeabilities of the positive circularly polarized wave and the negative circularly polarized wave are given by:

$$\mu+=\mu+'+j\mu+''$$

$$\mu-=\mu-'+j\mu-''$$

FIG. 23 illustrates an exemplary characteristic of the ferrite core 16. As is apparent from FIG. 23, the loss term (imaginary part) of the complex permeability of the positive circularly polarized wave is large, and magnetic resonance absorption occurs at around 2 GHz. On the other hand, the complex permeability of the negative circularly polarized wave has a flat characteristic, and magnetic resonance absorption does not occur.

When the magnetic field of the two modes generated by the signal input from the input/output terminal 8*a* passes through the ferrite core 16, the circularly polarized wave rotates in the direction in which the magnetic resonance absorption does not occur, in which case a signal is output to the input/output terminal 8*b*. Conversely, when the magnetic field of the two modes generated by the signal input from the input/output terminal 8*b* passes through the ferrite core 16, the circularly polarized wave rotates in the direction in which the magnetic resonance absorption occurs, and a signal is not output to the input/output terminal 8*a*. This arrangement therefore acts as an isolator.

Figure 16:
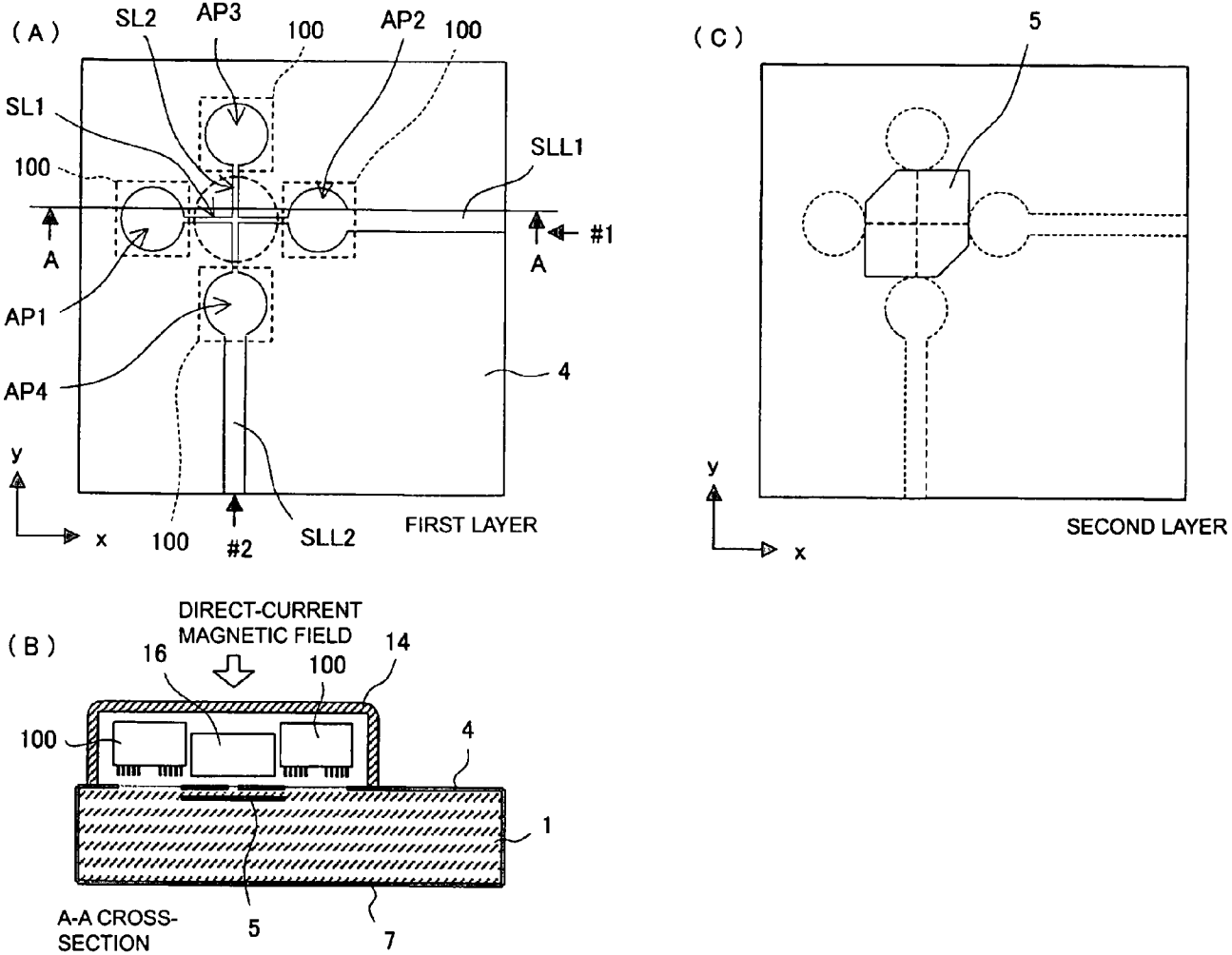
FIGS. 16(A)-16(C) are diagrams showing a structure of a resonator according to a tenth embodiment.

FIGS. 16(A)-16(C) are diagrams showing a structure of an isolator according to a tenth embodiment. FIG. 16(A) is a top view of the isolator from which a shield cap is removed, and FIG. 16(B) is a cross-sectional view of the isolator, taken along line A-A in FIG. 16(A) when the shield cap is attached. FIG. 16(C) is a plan view of an inner layer pattern of a dielectric substrate. A conductor layer 4 including conductor openings AP1 to AP4 and slits SL1 and SL2 are defined on the upper surface of the dielectric substrate 1. The conductor layer 4 further includes a slot SLL1 extending in the opposite direction to the AP1 direction from the conductor opening AP2, and a slot SLL2 extending in the opposite direction to the AP3 direction from the conductor opening AP4.

A capacitance-forming conductor layer 5 is asymmetric with respect to the x- and y-axis directions. Therefore, the frequencies of the even mode and the odd mode shown in FIGS. 2(A)-2(B) differ, and the X mode in which the magnetic field vectors are entirely directed in the x-axis direction and the Y mode in which the magnetic field vectors are entirely directed in the y-axis direction are coupled (see FIGS. 3(A)-3(D)).

The slot SLL1 is coupled to the magnetic field of the X mode, and a signal propagates in the transmission mode of the slot line. The slot SLL2 is coupled to the magnetic field of the Y mode, and a signal propagates in the transmission mode of the slot line. This arrangement therefore acts as an isolator in which a signal can be input and output via slot lines.

Figure 17:
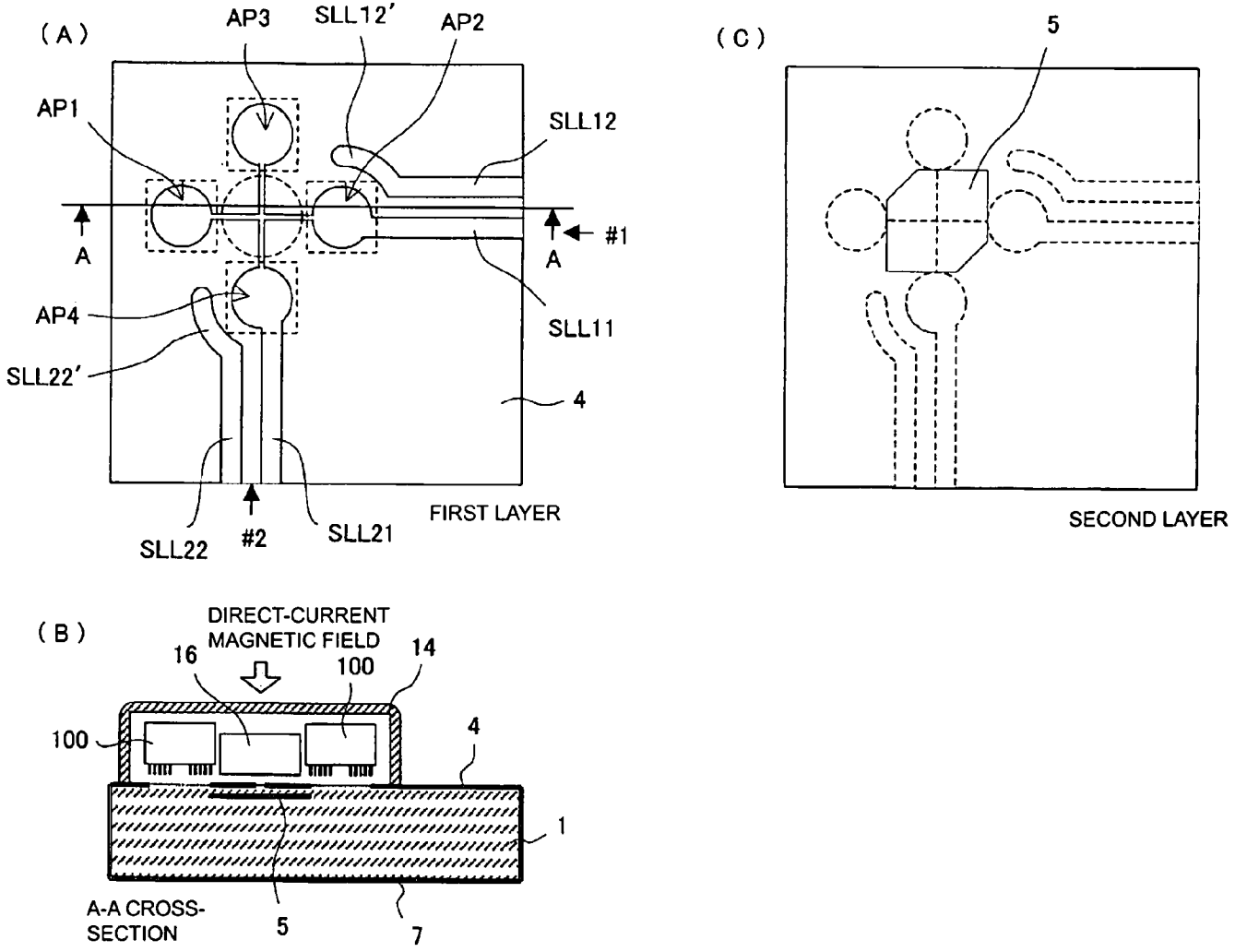
FIGS. 17(A)-17(C) are diagrams showing a structure of a resonator according to an eleventh embodiment.

FIGS. 17(A)-17(C) are diagrams showing a structure of an isolator according to an eleventh embodiment. FIG. 17(A) is a top view of the isolator from which a shield cap is removed, and FIG. 17(B) is a cross-sectional view of the isolator, taken along line A-A in FIG. 17(A) when the shield cap is attached. FIG. 17(C) is a plan view of an inner layer pattern of a dielectric substrate.

In this example, a slot SLL11 extending in the opposite direction to an AP1 direction from a conductor opening AP2 and a slot SLL12 extending along the slot SLL11 from the vicinity of the conductor opening AP2 are defined to form a coplanar guide. Likewise, a slot SLL21 extending in the opposite direction to an AP3 direction from a conductor opening AP4 and a slot SLL22 extending along the slot SLL21 from the vicinity of the conductor opening AP4 are defined to form a coplanar guide. This arrangement therefore acts as an isolator including the coplanar guides serving as input/output means.

Figure 18:
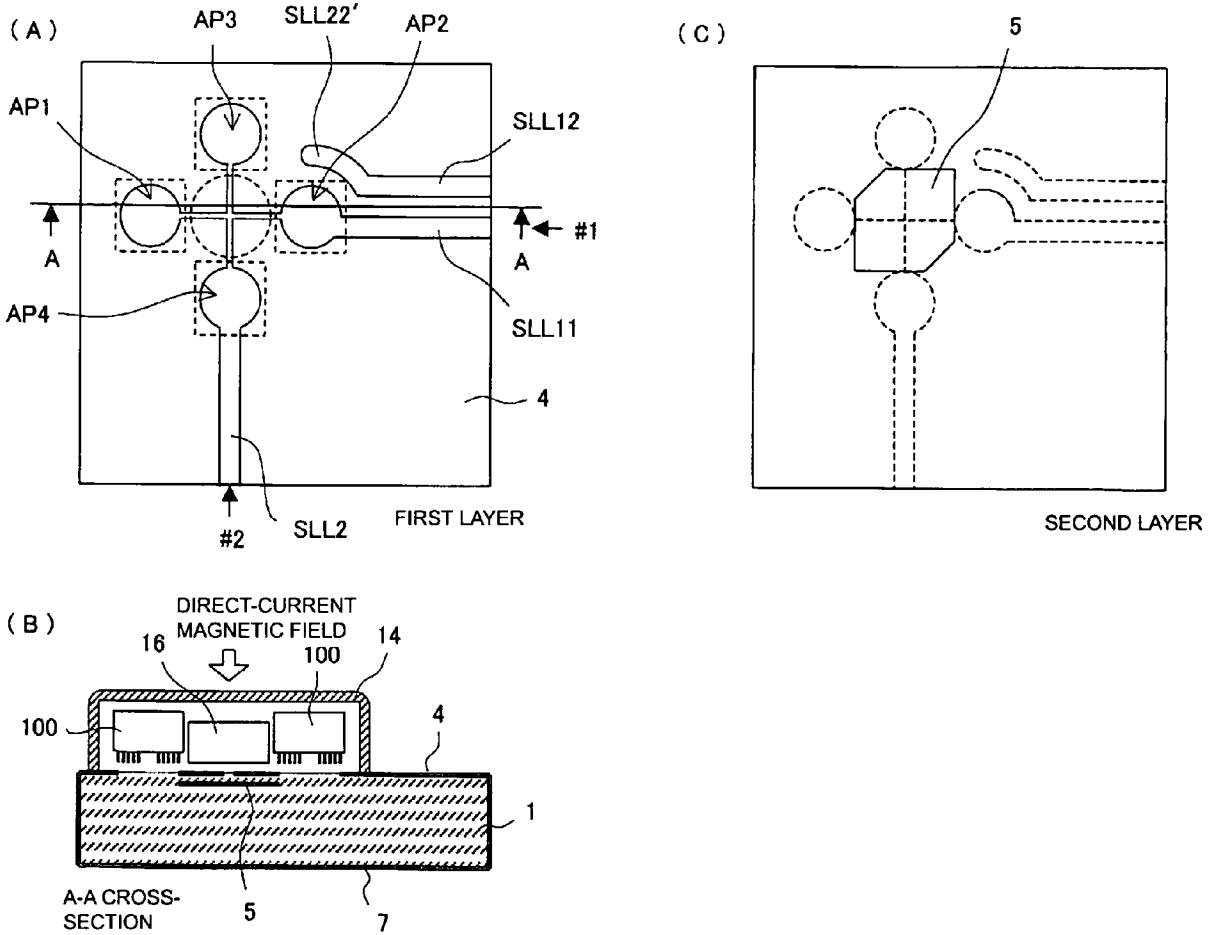
FIGS. 18(A)-18(C) are diagrams showing a structure of a resonator according to a twelfth embodiment.

FIGS. 18(A)-18(C) are diagrams showing a structure of an isolator according to a twelfth embodiment. In this example, a slot SLL11 extending in the opposite direction to an AP1 direction from a conductor opening AP2 and a slot SLL12 extending along the slot SLL11 from the vicinity of the conductor opening AP2 are defined to form a coplanar guide. Further, a slot SLL2 extending in the opposite direction to an AP3 direction from AP4 is defined. The other structure is similar to that shown in FIGS. 16(A)-16(C) and 17(A)-17(C). This arrangement therefore acts as an isolator including the coplanar guide serving as one input/output unit and the slot line serving as the other input/output unit.

Figure 19:
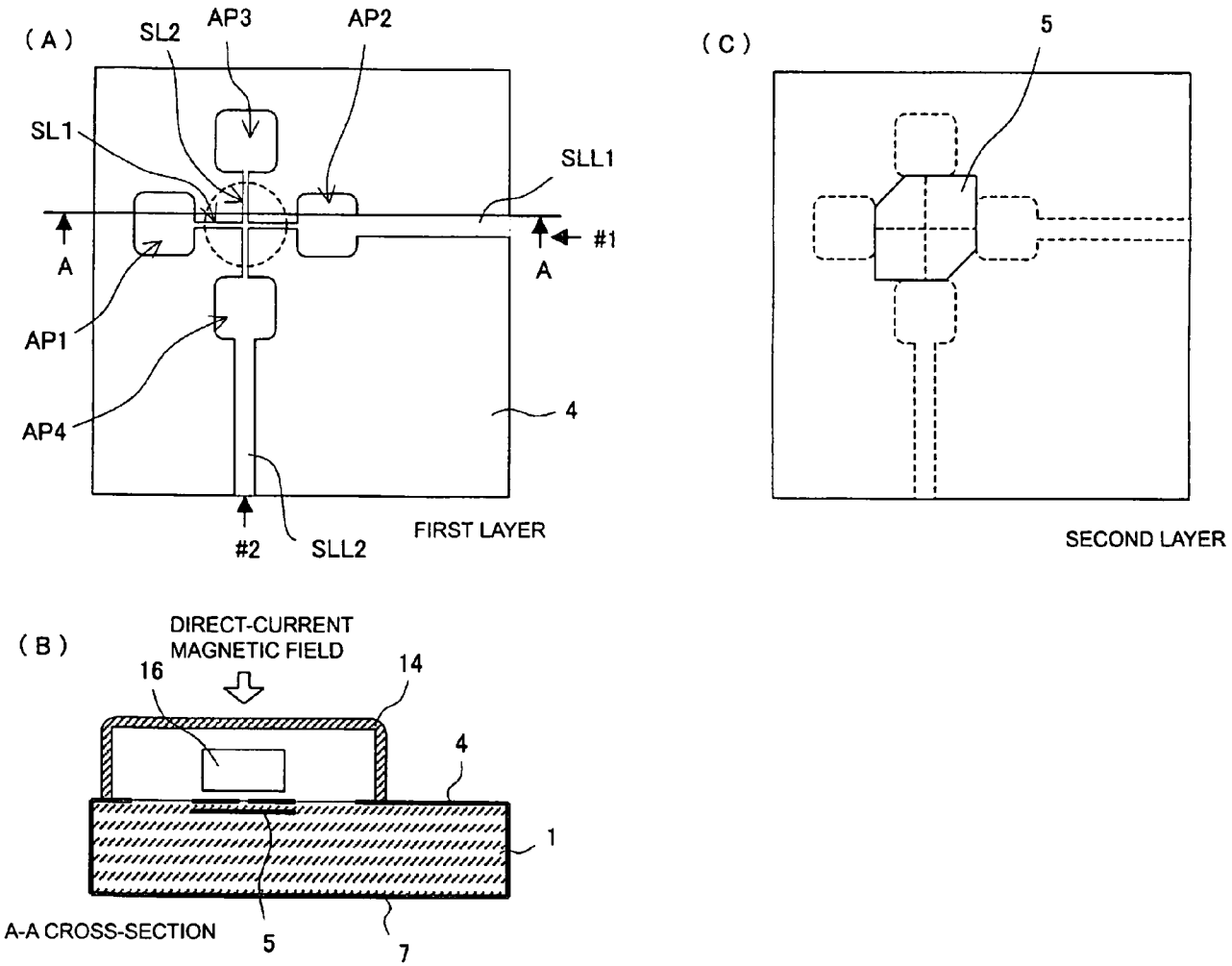
FIGS. 19(A)-19(C) are diagrams showing a structure of a resonator according to a thirteenth embodiment.

FIGS. 19(A)-19(C) are diagrams showing a structure of an isolator according to a thirteenth embodiment. In this example, the shape of conductor openings AP1 to AP4 is substantially rectangular with four rounded corners. The resonant element 100 is not used. The other portions are similar to those shown in FIGS. 16(A)-16(C). Thus, the conductor openings may have any shape other than circular, and this arrangement also acts as an isolator.

Figure 20:
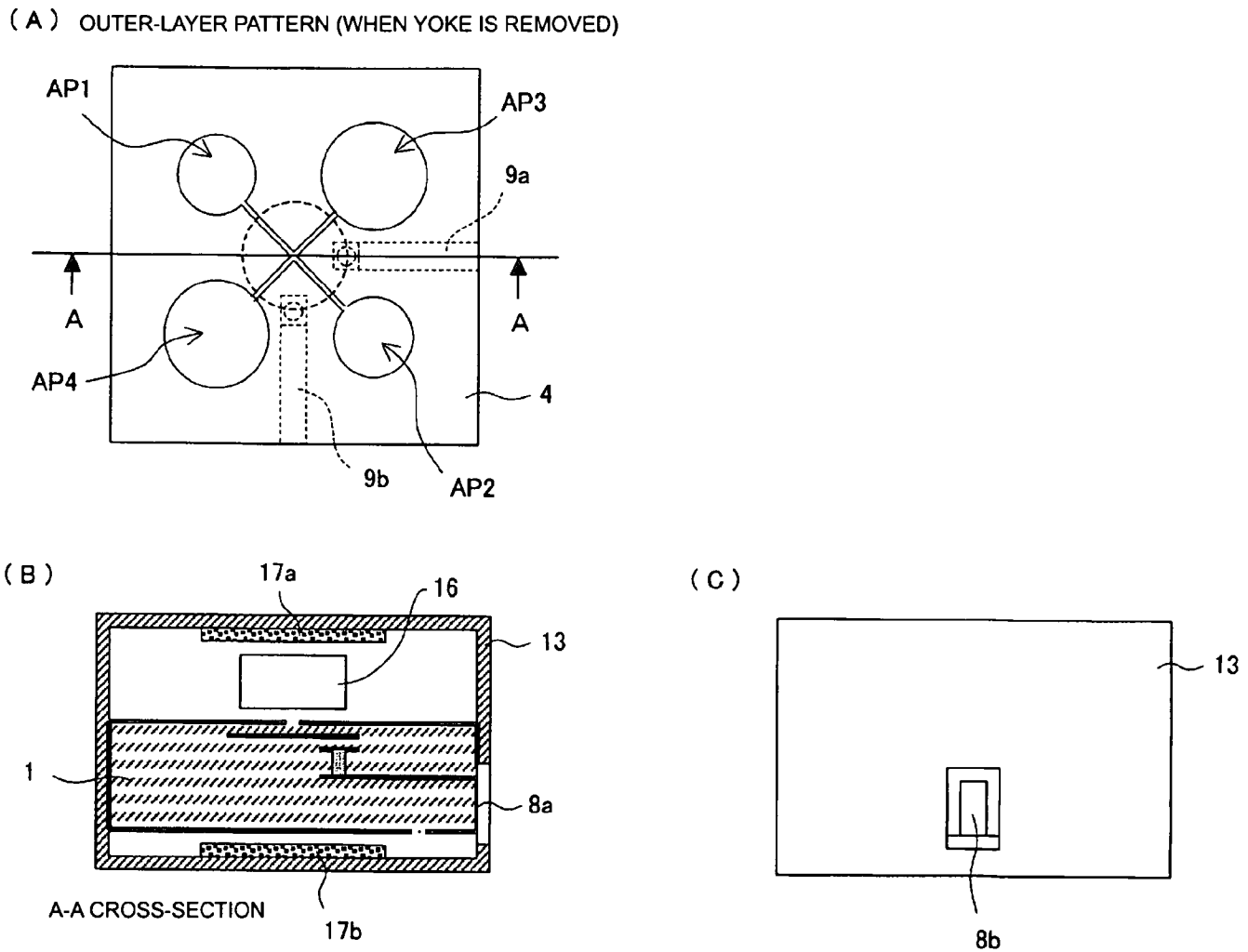
FIGS. 20(A)-20(C) are diagrams showing a structure of a resonator according to a fourteenth embodiment.
Figure 21:
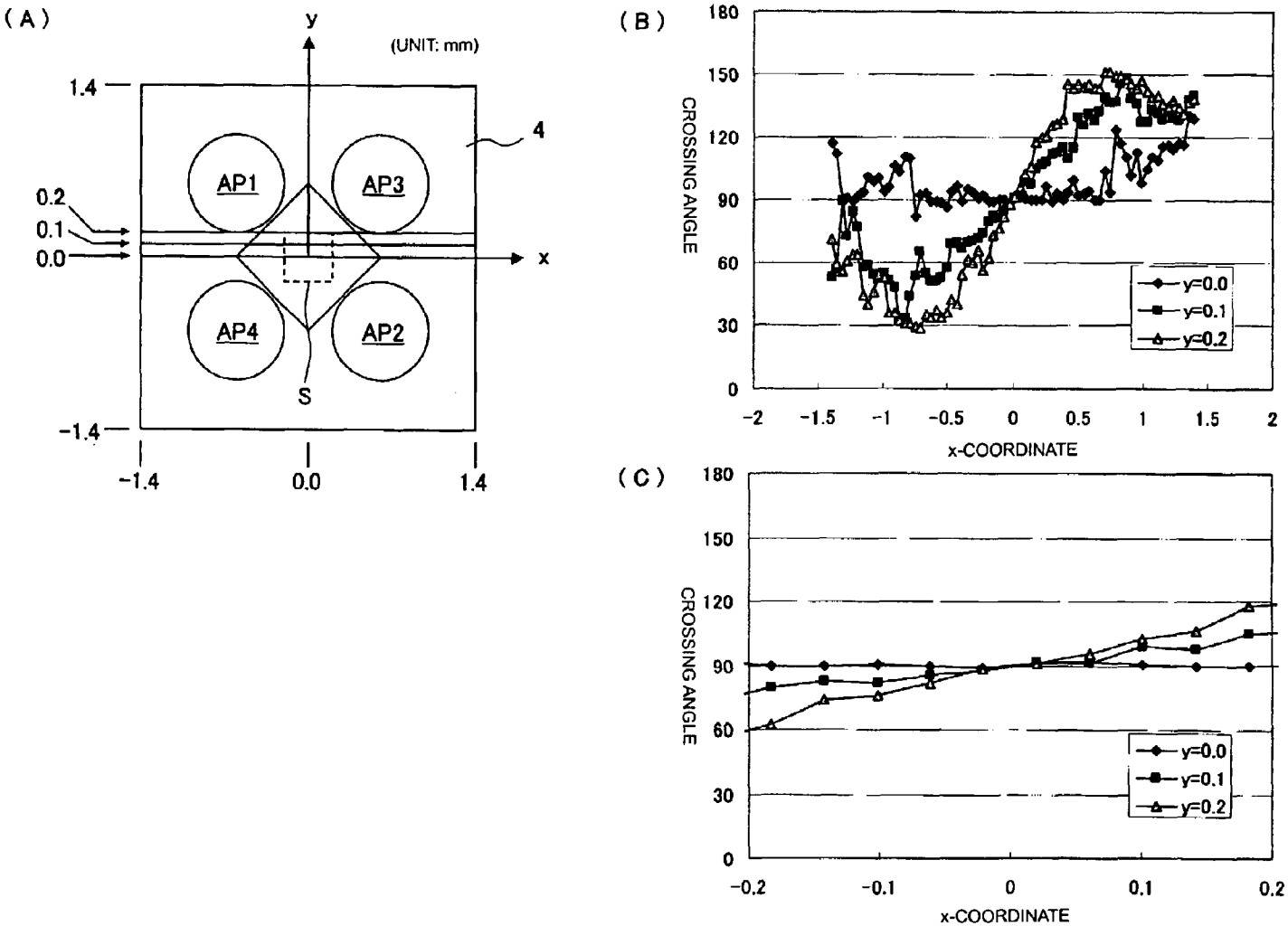
FIGS. 21(A)-21(C) are diagrams showing a crossing angle of magnetic field vectors.
Figure 22:
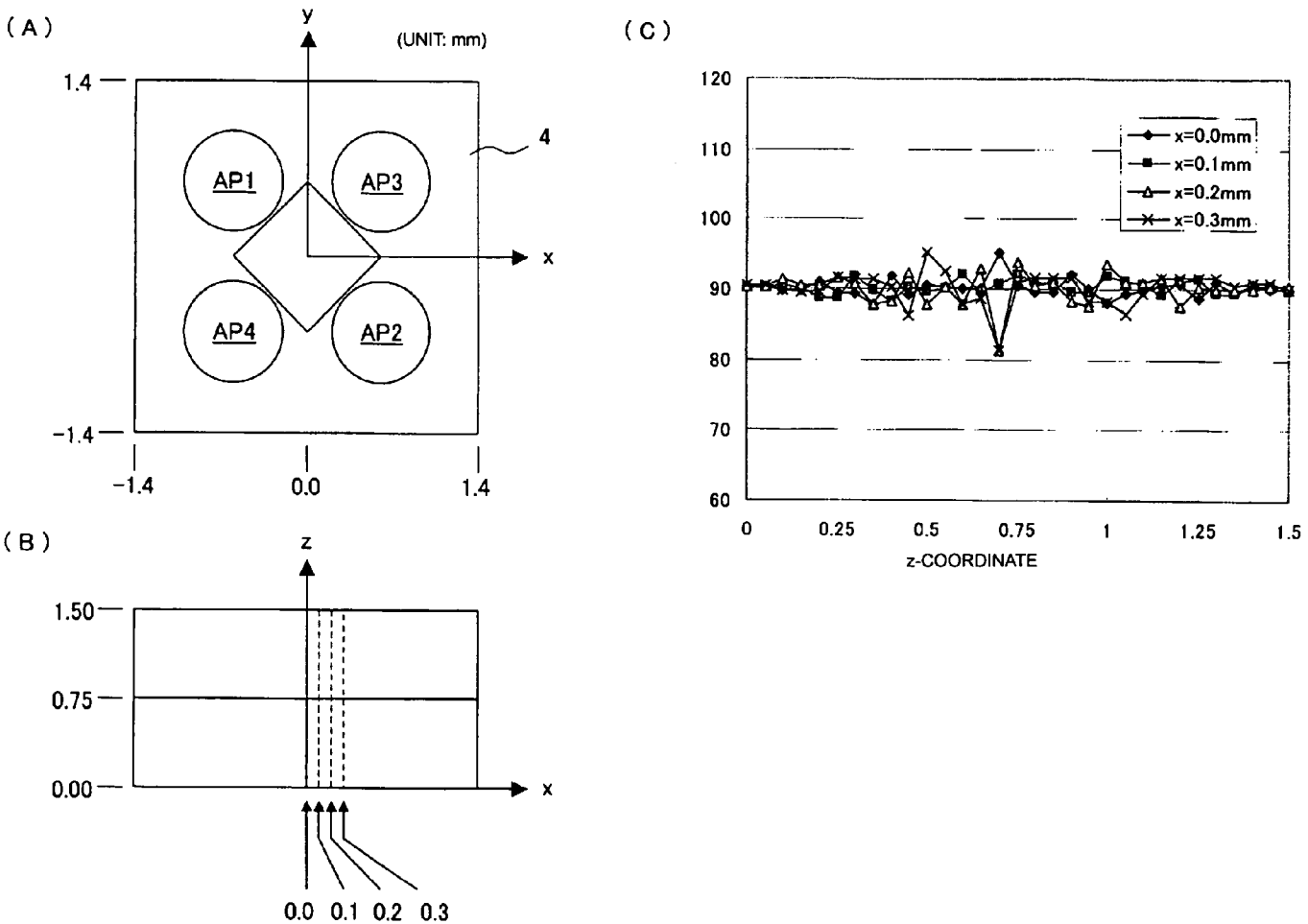
FIGS. 22(A)-22(C) are diagrams showing a crossing angle of magnetic field vectors.

FIGS. 20(A)-20(C) are diagrams showing a structure of an isolator according to a fourteenth embodiment. FIG. 20(A) is a top view of a dielectric substrate before the dielectric substrate is received in a shield case, and FIG. 20(B) is a cross-sectional view of the isolator, taken along line A-A in FIG. 20(A). FIG. 20(C) is a front view of the isolator. The structure of the dielectric substrate 1 and conductor layers and via-holes defined on the dielectric substrate 1 is similar to that shown in FIGS. 15(A)-15(F). In the example shown in FIGS. 20(A)-20(C), the dielectric substrate 1, a ferrite core 16, and magnets 17*a* and 17*b* are integrally received in a shield case 13. The shield case 13 is magnetic, and acts not only as a shield to high-frequency signals but also as a yoke for the magnets 17*a* and 17*b*.

Figure 27:
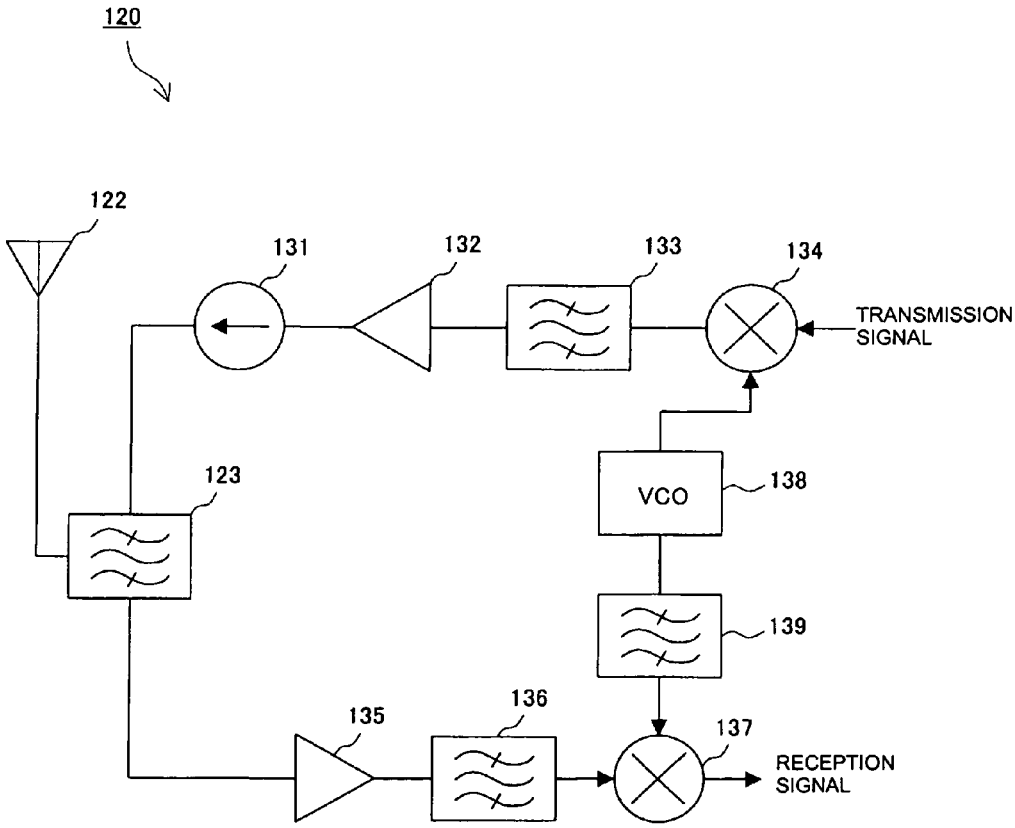
FIG. 27 is a block diagram showing a structure of a communication apparatus according to a fifteenth embodiment.
Figure 28:
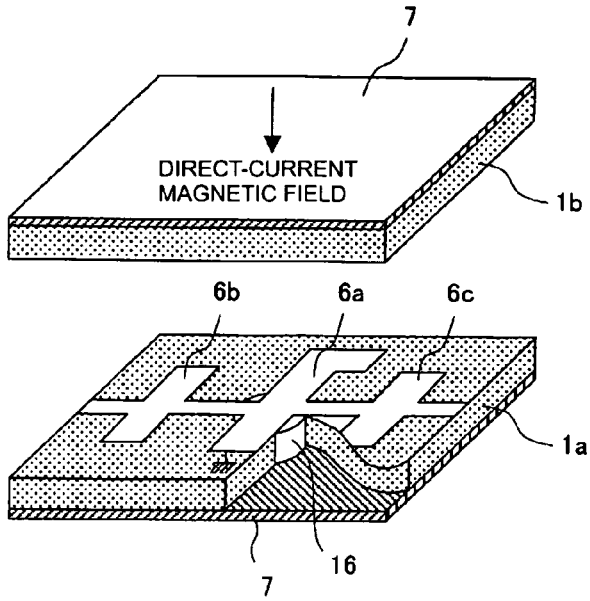
FIG. 28 is an exploded perspective view showing a structure of a cross-shaped strip-line resonance isolator of the related art.
Figure 29:
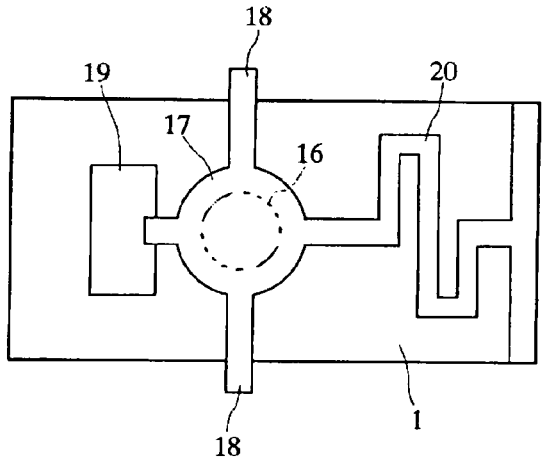
FIG. 29 is a diagram showing a structure of a nonreciprocal circuit device disclosed in Patent Document 1.
Figure 30:
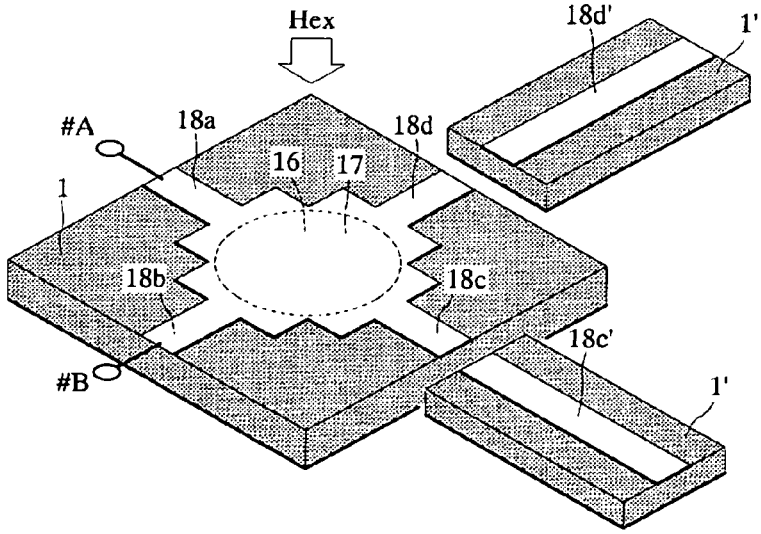
FIG. 30 is a diagram showing a structure of a nonreciprocal circuit device disclosed in Patent Document 2.

Next, a structure of a communication communication apparatus according to a fifteenth embodiment of the present invention will be described with reference to FIG. 27. FIG. 27 is a block diagram showing the structure of the main part of the communication apparatus. A transmission system of the apparatus includes a voltage controlled oscillator (VCO) 138, a mixer 134, a band-pass filter 133, an amplifier 132, an isolator 131, and a transmission filter of a duplexer 123. The mixer 134 mixes an oscillation signal of the VCO 138 with a transmission signal, and the band-pass filter 133 transmits a necessary transmission-band signal. The transmitted signal is amplified by the amplifier 132, and is transmitted from an antenna 122 via the isolator 131 and the transmission filter of the duplexer 123. A reception system includes a reception filter of the duplexer 123, an amplifier 135, a band-pass filter 136, a mixer 137, and a band-pass filter 139. A reception signal from the antenna 122 is amplified by the amplifier 135 via the reception filter of the duplexer 123, and only a necessary reception signal band is selected by the band-pass filter 136. The mixer 137 mixes the resulting signal with a local signal output from the band-pass filter 139, and outputs a reception signal to a receiving circuit.

The filter with the structure illustrated in the above-described embodiments can be applied to any of the duplexer 123 and the band-pass filters 133, 136, and 139. The isolator with the structure illustrated in the above-described embodiments can be applied to the isolator 131.

The invention claimed is:

1. A resonator comprising:

a substrate; and a conductor layer located on the substrate, the conductor layer having first and second conductor openings directly connected to each other at respective ends of a first slit, and third and fourth conductor openings directly connected to each other at respective ends of a second slit, and the first slit and the second slit intersecting each other.

2. The resonator according to claim 1, further comprising:

a capacitance-forming conductor layer adjacent to the conductor layer, and an insulating layer therebetween, wherein the capacitance-forming conductor layer overlaps four sections of the conductor layer defined by the intersecting first and second slits.

3. The resonator according to claim 1, wherein a magnetic field or an electric field of two resonant modes in which a magnetic field vector enters or exits the first through fourth conductor openings is unbalanced.

4. The resonator according to claim 1, wherein at least one of the first through fourth conductor openings comprises a resonant element including at least one ring-shaped resonance unit, each resonance unit having at least one conductor line, a capacitive area and an inductive area.

5. A communication apparatus comprising a resonator according to claim 1.

6. A filter comprising:

a resonator according to claim 1; and signal input/output means coupled to the resonator.

7. A communication apparatus comprising a filter according to claim 6.

8. A nonreciprocal circuit device comprising:

a resonator comprising:

a substrate; and a conductor layer located on the substrate, the conductor layer having first and second conductor openings in communication with each other via a first slit, and third and fourth conductor openings in communication with each other via a second slit, and the first slit and the second slit intersecting each other; and a magnet that applies a direct-current magnetic field to a ferrite member, the ferrite member being disposed in a region surrounded by the first through fourth conductor openings.

9. The nonreciprocal circuit device according to claim 8, wherein the first slit and the second slit intersect at substantially a right angle.

10. A communication apparatus comprising a nonreciprocal circuit device according to claim 8.

11. A resonator comprising:

a substrate; and a conductor layer located on the substrate, the conductor layer having first and second conductor openings in communication with each other via a first slit, and third and fourth conductor openings in communication with each other via a second slit, and the first slit and the second slit intersecting each other, wherein at least one of the first through fourth conductor openings comprises a resonant element including at least one ring-shaped resonance unit, each resonance unit having at least one conductor line, a capacitive area and an inductive area, and wherein an end of the conductor line is arranged adjacent to the other end of the conductor line to form the capacitive area.

12. A resonator comprising:

a substrate; and a conductor layer located on the substrate, the conductor layer having first and second conductor openings in communication with each other via a first slit, and third and fourth conductor openings in communication with each other via a second slit, and the first slit and the second slit intersecting each other, wherein at least one of the first through fourth conductor openings comprises a resonant element including at least one ring-shaped resonance unit, each resonance unit having at least one conductor line, a capacitive area and an inductive area, and wherein an end of the conductor line is arranged adjacent to an end of another conductor line included in the same resonance unit in a width direction or a thickness direction to form the capacitive area.

* * * * *

UNITED STATES PATENT AND TRADEMARK OFFICE

CERTIFICATE OF CORRECTION

PATENT NO. : 7,471,173 B2
APPLICATION NO. : 10/578496
DATED : December 30, 2008
INVENTOR(S) : Seiji Hidaka et al.

It is certified that error appears in the above-identified patent and that said Letters Patent is hereby corrected as shown below:

Title page, item (75) should read as follows:
Inventors: Seiji Hidaka, Nagaokakyo-shi (JP); Hiromu Tokudera, Nagaokakyo-shi (JP); Kei Matsutani, Mishima-gun (JP)

Signed and Sealed this

Seventeenth Day of February, 2009

JOHN DOLL
*Acting Director of the United States Patent and Trademark Office*